US011365929B1

(12) United States Patent
Marinelli

(10) Patent No.: US 11,365,929 B1
(45) Date of Patent: Jun. 21, 2022

(54) CENTRAL AIR CONDITIONING AIR HANDLER SCENT INJECTOR AND DRAIN LINE FLUSH

(71) Applicant: Vittorio Marinelli, Pompano Beach, FL (US)

(72) Inventor: Vittorio Marinelli, Pompano Beach, FL (US)

( * ) Notice: Subject to any disclaimer, the term of this patent is extended or adjusted under 35 U.S.C. 154(b) by 670 days.

(21) Appl. No.: 15/253,789

(22) Filed: Aug. 31, 2016

Related U.S. Application Data

(63) Continuation-in-part of application No. 13/329,189, filed on Dec. 16, 2011, now Pat. No. 9,435,550.

(60) Provisional application No. 61/424,614, filed on Dec. 17, 2010.

(51) Int. Cl.
*F25D 21/14* (2006.01)
*F25D 29/00* (2006.01)

(52) U.S. Cl.
CPC ..... *F25D 21/14* (2013.01); *F25D 29/00* (2013.01); *F25D 2321/143* (2013.01)

(58) Field of Classification Search
CPC .... F25D 21/14; F25D 29/00; F25D 2321/143; F24F 2013/227; F24F 13/22; F24F 13/224; F24F 2013/225; F24F 2013/228
USPC ..... 454/110
See application file for complete search history.

(56) References Cited

U.S. PATENT DOCUMENTS 2,523,373 A 9/1950 Jennings et al.
4,303,617 A 12/1981 Bryson
4,601,886 A 7/1986 Hudgins
4,617,157 A 10/1986 Stein et al.
4,780,253 A 10/1988 Fukuhara et al.
4,913,034 A 4/1990 Ripple et al.
4,937,559 A * 6/1990 Meacham ..... F24F 13/22 200/61.04
4,998,412 A * 3/1991 Bell ..... F24F 13/22 134/166 C
5,011,632 A 4/1991 Yano et al.
5,015,442 A 5/1991 Hirai
5,023,020 A 6/1991 Machida et al.
5,030,253 A 7/1991 Tokuhiro et al.
5,174,967 A 12/1992 Fukuhara
5,186,869 A 2/1993 Stumpf et al.
5,196,125 A * 3/1993 O'Brien ..... A01G 25/06 210/170.08

(Continued)

*Primary Examiner* — Avinash A Savani
*Assistant Examiner* — Ryan L Faulkner
(74) *Attorney, Agent, or Firm* — Allen D. Hertz, P.A.; Allen D. Hertz

(57) ABSTRACT

Enhancements to an air handler of an air conditioning system. The enhancements can include a scent dispersion system, a heat exchanger rinse system, and/or an air handler condensation drain pipe flush system. The scent dispersion system employs a pressure differential established within the air handler to draw a scent mist from a scent reservoir. The scent is disbursed throughout the structure by the air conditioning ventilation system. The heat exchanger rinse system dispenses a rinse fluid onto the heat exchanger. A cleaning composition can be injected into the rinse fluid to aid in the cleaning process. The flush system automatically configures a check valve upstream of the flush injection point. A flush fluid flows through the drain pipe applying a pressure to dislodge a blockage therein. A chemical composition can be added into the flush fluid to assist in the dislodging process.

20 Claims, 16 Drawing Sheets

(56) References Cited

U.S. PATENT DOCUMENTS 5,293,894 A * 3/1994 Fleischmann ..... F04F 10/00 137/135
5,302,359 A 4/1994 Nowatzki et al.
5,397,398 A * 3/1995 Van Vlahakis ..... B08B 9/032 134/22.11
5,466,399 A 11/1995 Von Kempski et al.
5,664,423 A * 9/1997 Akazawa ..... B60H 3/0007 62/303
5,704,832 A 1/1998 Borrell
5,756,047 A 5/1998 West et al.
5,911,742 A 6/1999 Akazawa
5,942,597 A 7/1999 Lynn
5,931,172 A * 8/1999 Steer ..... B08B 7/00 134/2
5,957,771 A 9/1999 Baek
5,958,346 A 9/1999 Evans, Jr.
6,129,110 A * 10/2000 Kolb ..... F16K 31/18 137/391
6,347,992 B1 2/2002 Durbin et al.
6,363,734 B1 4/2002 Aoyagi
6,371,451 B1 4/2002 Choi
6,379,242 B1 * 4/2002 Wiseman, Sr. ..... A61L 9/122 222/647
6,553,777 B2 4/2003 Dillenback
6,656,434 B1 12/2003 DeMarcki
6,766,651 B2 7/2004 Dillenback
6,887,299 B2 5/2005 Weigl
7,188,485 B2 3/2007 Szpekman
7,223,166 B1 5/2007 Wiseman et al.
7,392,658 B1 * 7/2008 Hardy, III ..... A23L 3/36 137/15.05
8,157,508 B2 4/2012 Vano et al.
8,255,089 B2 8/2012 Luc et al.
8,483,883 B1 7/2013 Watson
2006/0037330 A1 2/2006 Weigl
2006/0121844 A1 6/2006 Sparks, II
2007/0101745 A1 * 5/2007 Hsu ..... F24F 1/42 62/305
2007/0181000 A1 8/2007 Wilson et al.
2007/0187530 A1 8/2007 Byrd
2007/0217771 A1 9/2007 Granger et al.
2008/0121734 A1 5/2008 Cappellina
2008/0207107 A1 8/2008 Matsuo et al.
2008/0256975 A1 * 10/2008 Lifson ..... F25B 1/10 62/510
2009/0056346 A1 * 3/2009 Zatarain ..... F25D 21/14 62/55.5
2010/0219258 A1 9/2010 Starcic
2011/0308546 A1 * 12/2011 Kaiser ..... B08B 9/027 134/18
2011/0308557 A1 * 12/2011 Kaiser ..... F24F 13/222 134/56 R
2011/0308636 A1 * 12/2011 Kaiser ..... F24F 13/222 137/101.27
2012/0012188 A1 * 1/2012 Matheis ..... B08B 9/0325 137/2
2012/0156980 A1 6/2012 Zelicovich
2015/0136240 A1 * 5/2015 Sundholm ..... B65F 5/005 137/15.05

* cited by examiner

CENTRAL AIR CONDITIONING AIR HANDLER SCENT INJECTOR AND DRAIN LINE FLUSH

CROSS-REFERENCE TO RELATED APPLICATION

This Non-Provisional Utility Patent Application is:

a Continuation-In-Part, claiming the benefit of U.S. Provisional patent application Ser. No. 13/329,189, filed on Dec. 16, 2011 (scheduled to issue as U.S. Pat. No. 9,435,550 on Sep. 6, 2016), which claims the benefit of U.S. Provisional Patent Application Ser. No. 61/424,614, filed on Dec. 17, 2010, which is incorporated herein in its entirety.

FIELD OF THE INVENTION

The present invention relates to a scent and disinfectant disbursement apparatus and method. More specifically, the scent and disinfectant disbursement apparatus utilizes a pressure gradient across a central air conditioning system air handler to draw and distribute scented fumes from a scent oil reservoir.

BACKGROUND OF THE INVENTION

The invention pertains to a scent and disinfectant disbursement apparatus, which utilizes a pressure gradient across a central air conditioning system air handler to draw and distribute scented fumes from a scent oil reservoir.

Central air conditioning systems disburse conditioned air throughout a structure. Air conditioning systems include a compressor and an air handler. Air conditioners utilize Boyle's law to manipulate a fluid to condition air temperature. The compressor adds energy into a system by pressurizing a fluid, which consequently elevates the temperature of the fluid. The heated fluid is then cooled to ambient temperature using fans. The ambient, compressed fluid is then allowed to expand, causing the fluid to cool. The air handler draws air in from an interior of a structure, passes the air across a heat exchanger, and returns the conditioned air to the structure through a distribution ducting system.

Disinfectant injection systems are currently available for introducing a disinfectant into an air conditioning system. These systems utilize pumps and inject vapor into the ducting portion of the air conditioning systems. In certain configurations, the system requires a parallel ducting section for the injection of the disinfectant vapor.

Air conditioning systems include a compressor, an air handler, a controller (usually a thermostat), and ventilation. The air conditioning system is designed to collect condensation in a base of the air handler. The collected condensation drains through a drain pipe, which is commonly routed from the air handler to a location external to the structure. The collected condensation commonly also collects dust, lint, and other debris. The collected debris can clog the air handler drain pipe. The clogged or blocked air handler drain pipe hinders draining of the collected condensation within the base of the air handler. The condensation can continue to collect and commonly overflows into the surrounding area. Newer air handlers include a float switch located within the condensation collection tray, wherein the float switch disables the air conditioning compressor when the air handler drain pipe is blocked and a concerning volume of condensation collects at the base of the air handler.

Typically, the air handler drain pipe is partially disassembled providing access to a flush system. The flush system can be pressurized air or flowing water. The pressurized air or flowing water would be forced downstream to dislodge and remove the blockage from within the air handler drain pipe.

Accordingly, there remains a need in the art for a device that provides an apparatus and method to inject a disinfectant and/or scent into an air conditioning without complicated and expensive components. Additionally, there remains a need in the art for a device that provides an apparatus and method to flush any debris from the air handler drain pipe to avoid any downtime and/or damage to the air conditioning system.

SUMMARY OF THE INVENTION

The present invention overcomes the deficiencies of the known art and the problems that remain unsolved by providing a method and respective apparatus for distributing a scented vapor a disinfectant throughout an interior of a structure, such as a residence or commercial building.

In accordance with one embodiment of the present invention, the invention consists of a vapor injection system, the system comprising:

- an air conditioning air handler integrated into a central air conditioning system, the air handler divided into a low pressure, air entry section, and a high pressure, air discharge section by a pressure divider wall;
- a scent injection assembly;
- a pressure application conduit having a first orifice end exposed to an environment within the high pressure, air discharge section and a second orifice end in fluid communication with the scent reservoir; and
- a scent injection conduit having a first orifice end in fluid communication with the scent reservoir and a second orifice end exposed to an environment within the low pressure, air entry section.

In a second aspect, a scent generating liquid is disposed within the scent injection assembly.

In another aspect, the scent injection assembly further comprises a scent reservoir and a scent injection body, wherein the scent reservoir is removably coupled to the scent injection body.

Yet another aspect, the scent injection assembly further comprises a scent control valve.

While another aspect, a scent operation control valve can be integrated within a section of the pressure application conduit.

With yet another aspect, the scent operation control valve can be integrated within a section of the scent injection conduit.

Yet another aspect, a plurality of scent dispersion reeds are disposed within the scent injection assembly, wherein the reeds are positioned extending upward from the scent generating liquid.

Regarding another aspect, an ultrasonic scent injection system comprising an ultrasonic system controller and an ultrasonic scent disbursement head, the ultrasonic system controller being in signal communication with the ultrasonic scent disbursement head and being positioned within the scent injection assembly.

In yet another aspect, the ultrasonic scent disbursement head is in fluid communication with the scent generating liquid.

In yet another aspect, the power controller for the air handler provides power to the ultrasonic scent disbursement head.

In yet another aspect, aerating the scent liquid can enhance the scent liquid vaporization. The aeration can be created by directing the pressurized airflow towards a bottom of the reservoir via an aerating conduit.

In yet another aspect, the aerator further comprises a backflow prevention device disposed at a discharge end of the aerating conduit. The backflow prevention device can be provided in a shape of an inverted U, discharging the airflow in a downward direction.

In yet another aspect, the aerator further comprises at least one check valve to further aid in controlling and minimizing any backflow.

In yet another aspect, a second exemplary embodiment of an aerator comprises a rotational shaft comprising at least one aerating blade assembly. The shaft is rotationally assembly via at least one bearing. In the exemplary embodiment, a bearing is positioned at each of an upper and a lower end of the shaft.

In yet another aspect, the second aerator embodiment is operationally driven by directing inlet airflow towards a drive blade assembly, the drive blade assembly being operationally engaged with the aerating shaft. The airflow rotates the aerating shaft, which rotates the aerating blade assembly. The aerating blade assembly aerates the scenting liquid.

And with another aspect, a method of use includes the steps of:

- obtaining a scent injection assembly, the scent injection assembly comprising a scent reservoir, an inlet orifice, and a discharge orifice;
- installing a pressure application conduit between a high pressure section of a central air conditioner air handler and the scent injection assembly inlet orifice;
- installing a pressure application conduit between a low pressure section of the central air conditioner air handler and the scent injection assembly discharge orifice;
- applying a pressure to the scent reservoir by powering the air handler, where the air handler creates a pressure gradient between the low pressure section and the high pressure section, the sections defined by a pressure divider wall;
- mixing a vaporized volume of scent generating liquid into airflow created by the air handler generated pressure; and
- injecting the vaporized volume of scent generating liquid into the low pressure section to be disbursed throughout an air conditioned structure using an air conditioning ducting system.

In another aspect, the scent generating liquid is vaporized using a plurality of scent dispersing reeds placed within the scent injection assembly.

In yet another aspect, the scent generating liquid is vaporized using an ultrasonic scent disbursement system.

In accordance with another embodiment of the present invention, the invention consists of an air handler heat exchanger rinse system, the system comprising:

- an air conditioning air handler integrated into a central air conditioning system, the air handler comprising a heat exchanger;
- an air handler heat exchanger rinse fluid delivery conduit in fluid communication with a rinse fluid supply;
- at least one heat exchanger rinse fluid delivery component adapted to dispense rinse fluid from a rinse delivery section onto the heat exchanger;
- a heat exchanger rinse supply flow control valve adapted to control fluid communication between the rinse fluid supply and the rinse delivery section of the air handler heat exchanger rinse fluid delivery conduit; and
- a controller for operating the heat exchanger rinse supply flow control valve.

In a second aspect, the air handler heat exchanger rinse system further comprises an automated controller.

In another aspect, the air handler heat exchanger rinse system further comprises an automated controller comprising a microprocessor and a clocking circuit.

In another aspect, the air handler heat exchanger rinse system further comprises an automated controller comprising a microprocessor, a non-volatile digital memory device in signal communication with the microprocessor, and a clocking circuit device in signal communication with the microprocessor.

In yet another aspect, the at least one heat exchanger rinse fluid delivery component is a spray nozzle.

In yet another aspect, the air handler heat exchanger rinse system further comprises chemical injection system, wherein the chemical injection system is adapted to inject a volume of a chemical cleaning composition into the rinse fluid.

In yet another aspect, the chemical cleaning composition can be a bleach based composition.

In yet another aspect, the chemical cleaning composition can include an antibacterial element.

In yet another aspect, the chemical cleaning composition can include an antifungal element.

In accordance with an operation of the air handler heat exchanger rinse system, the operation would include a method comprising steps of:

- cycling the air conditioning system;
- actuating the heat exchanger rinse supply flow control valve after a predetermined number of air conditioning cycles,
- rinsing the air handler heat exchanger with rinse fluid supplied from the rinse fluid source through the actuated heat exchanger rinse supply flow control valve; and
- closing the heat exchanger rinse supply flow control valve.

In another aspect the method further comprises a step of:

- actuating the rinse chemical cleaning composition supply valve,
- dispensing a volume of the chemical cleaning composition into the rinse fluid; and
- closing the rinse chemical cleaning composition supply valve.

In yet another aspect the predetermined number of air conditioning cycles can be one or more cycles.

In yet another aspect the predetermined number of air conditioning cycles can be replaced by a calendar schedule, such as number of hours, number of days, number of months, or the like.

In yet another aspect the rinse process can have an operation cycle based upon a predetermined period of time.

In yet another aspect the rinse process can operate based upon a predetermined volume of rinse fluid.

In yet another aspect the rinse process can provide a predetermined volume of rinse fluid.

In accordance with another embodiment of the present invention, the invention consists of an air handler drain pipe flush system, the system comprising:

an air conditioning air handler integrated into a central air conditioning system, the air handler comprising an air handler drain pipe;

an air handler drain pipe flush supply pipe adapted to provide fluid communication between a flush fluid supply and the air handler drain pipe;

an air handler drain pipe flush flow control valve adapted to control fluid communication between the drain pipe flush fluid supply and the air handler drain pipe; and a controller for operating the air handler drain pipe flush flow control valve.

In a second aspect, the air handler drain pipe flush system further comprises an automated controller.

In another aspect, the air handler drain pipe flush system further comprises a float valve actuator assembly.

In yet another aspect, the float valve actuator assembly is located in fluid communication between an air handler condensation collection section and the air handler drain pipe flush supply pipe.

In yet another aspect, the float valve actuator assembly includes a float valve adapted to limit flow of the drain pipe flush fluid towards the air handler condensation collection section.

In yet another aspect, the float valve actuator assembly includes a float valve comprising a float element adapted to float when subjected to a volume of fluid. The float element engages with a float valve ring seal creating a fluid impervious seal between the drain pipe flush fluid supply and the air handler drain pipe.

In yet another aspect, the float valve actuator assembly includes a float element, wherein the float element is adapted to be positioned into a closed valve configuration by flow from the drain pipe flush fluid.

In yet another aspect, the float valve actuator assembly includes a float switch.

In yet another aspect, the float valve actuator assembly includes a float switch, wherein the float switch is activated by the float valve.

In yet another aspect, the float valve actuator assembly includes a float switch, wherein the float switch is adapted to control operation of the air condition. The float switch would deactivate the air conditioner when the float switch is in a closed configuration and enables normal operation of the air condition when the float switch is in an open configuration.

In yet another aspect, the air handler drain pipe includes a J trap section.

In yet another aspect, the air handler drain pipe flush supply pipe injects drain flush fluid between the air handler and the J trap section.

In yet another aspect, the air handler drain pipe flush supply pipe injects drain flush fluid between the float valve actuator assembly and the J trap section.

In yet another aspect, the air handler drain pipe flush system further comprises an automated controller comprising a microprocessor and a clocking circuit.

In yet another aspect, the air handler drain pipe flush system further comprises an automated controller comprising a microprocessor, non-volatile digital memory, and a clocking circuit.

In another aspect, the automated controller is provided in signal communication with an air conditioner thermostat or other air conditioning system controller.

In yet another aspect, the air handler drain pipe flush system further comprises chemical injection system, wherein the chemical injection system is adapted to inject a volume of a chemical cleaning composition into the flush fluid.

In yet another aspect, the chemical cleaning composition can be a bleach based composition.

In yet another aspect, the chemical cleaning composition can include an antibacterial element.

In yet another aspect, the chemical cleaning composition can include an antifungal element.

In accordance with an operation of the air handler heat exchanger rinse system, the operation would include a method comprising steps of:

cycling the air conditioning system;

actuating the heat exchanger drain pipe flush supply flow control valve after a predetermined number of air conditioning cycles, using flush fluid from the flush fluid supply to dislodge any blockage or debris in the air handler drain pipe; and closing the heat exchanger drain pipe flush supply flow control valve.

In another aspect the method further comprises a step of:

actuating the flush chemical cleaning composition supply valve, dispensing a volume of the chemical cleaning composition into the flush fluid; and closing the flush chemical cleaning composition supply valve.

In yet another aspect the predetermined number of air conditioning cycles can be one or more cycles.

In yet another aspect, the method can further comprise a step of closing a float valve located between the drain pipe flush fluid source and the air handler condensation collection section, blocking any flow of the drain pipe flush fluid into the air handler.

In yet another aspect, the method can further comprise a step of using the flush fluid to close the float valve located between the drain pipe flush fluid source and the air handler condensation collection section, blocking any flow of the drain pipe flush fluid into the air handler.

In yet another aspect the predetermined number of air conditioning cycles can be replaced by a calendar schedule, such as number of hours, number of days, number of months, or the like.

In yet another aspect the flush process can have an operation cycle based upon a predetermined period of time.

In yet another aspect the flush process can operate based upon a predetermined volume of flush fluid.

In yet another aspect the flush process can provide a predetermined volume of flush fluid.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
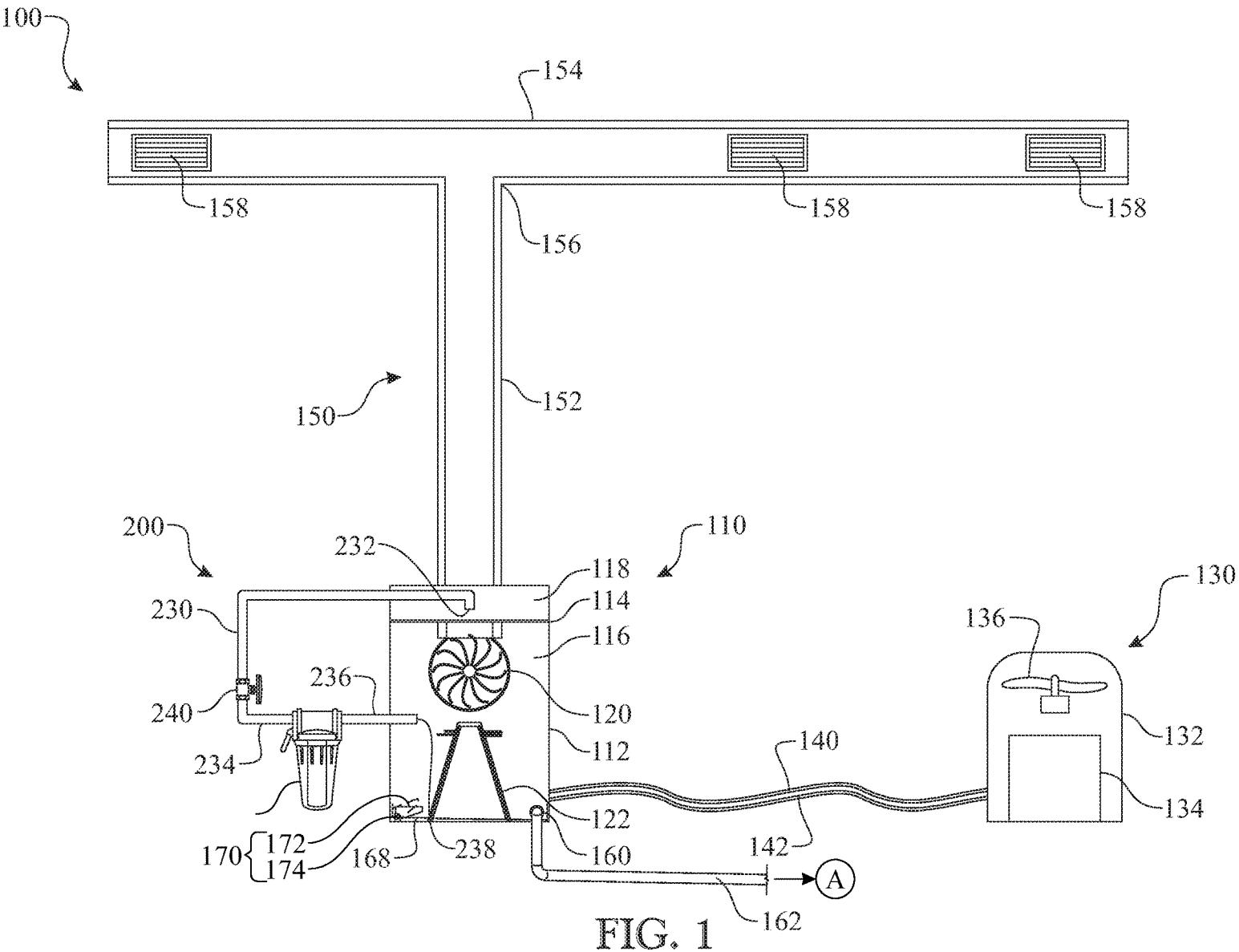
FIG. 1 presents an elevation view of an exemplary central air conditioning system having a scent injection system integrated therewith.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
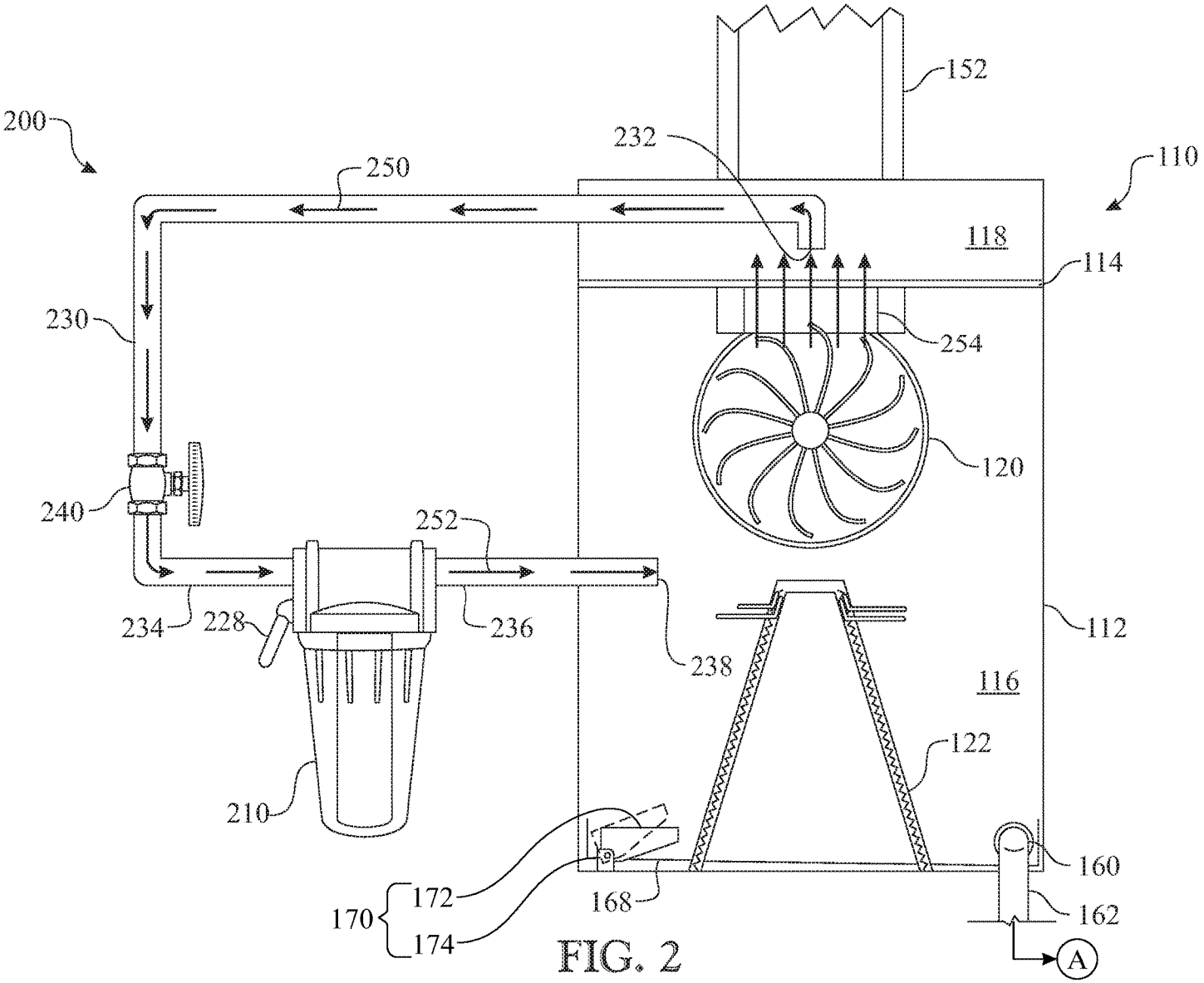
FIG. 2 presents an enlarged elevation view of an exemplary air conditioning air handler having the scent injection system integrated therewith as originally presented in FIG. 1.
Figure 3:
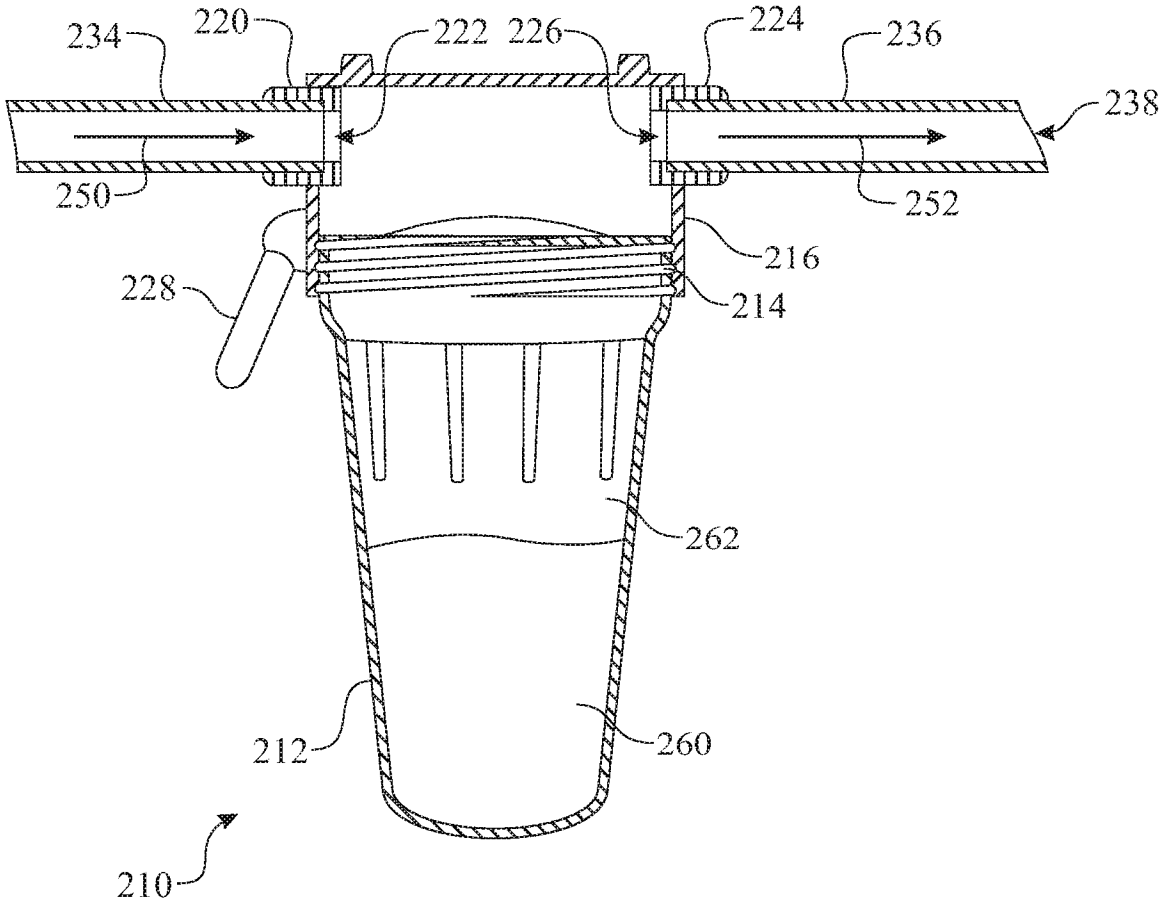
FIG. 3 presents a sectioned elevation view of the scent injection system.

A central air conditioning system 100 comprising a scent dispersion system 200 is illustrated in FIG. 1, with details of the system being presented in the illustration in FIGS. 2 and 3. The central air conditioning system 100 is disposed within a structure, such as a residence, an office building, a service provider building (such as a hospital), a storage facility, and any other facility. The central air conditioning system 100 includes components common to a centralized air conditioning system, including an air conditioning air handler 110, a compressor assembly 130, and an air conditioning ducting 150. The air conditioning air handler 110 and compressor assembly 130 condition the air to a desired temperature. The air conditioning ducting 150 distributes the conditioned air throughout the structure.

The compressor assembly 130 includes a compressor 134 and a compressor fan 136 integrated into a compressor housing 132. The air conditioning air handler 110 includes an air handler fan 120 and a heat exchanger 122 integrated within an air handler housing 112. The air handler housing 112 is segmented into a low pressure section 116 and a high pressure section 118 by a pressure divider wall 114. The air handler fan 120 creates a pressure gradient between the low pressure section 116 and the high pressure section 118 as referenced.

The air conditioning system utilizes a refrigerant to provide a thermal adjustment to the ambient air. The refrigerant is supplied to the compressor assembly 130 by a refrigerant supply conduit 140, and then compressed by the compressor 134. As the refrigerant is compressed, the refrigerant increases in temperature in accordance with Boyle's law (alternately referred to as the Ideal Gas law). The compressor fan 136 cools the compressed refrigerant, preferably returning to an ambient temperature. The pressurized refrigerant is transferred to the air conditioning air handler 110 by a refrigerant return conduit 142. The refrigerant expands within the heat exchanger 122. As the refrigerant expands, the refrigerant cools in accordance with Boyle's law. Ambient air passes across the heat exchanger 122. The heat exchanger 122 conditions the air temperature to the desired temperature. The conditioned air is transferred through the facility by the air handler fan 120 and the air conditioning ducting 150. The air handler fan 120 creates the airflow and the air conditioning ducting 150 distributes the conditioned air.

A trunk ducting 152 transfers the conditioned air from the air conditioning air handler 110 to a branch ducting 154. A ducting transition 156 provides fluid communication between the trunk ducting 152 and the branch ducting 154. The branch ducting 154 is routed throughout the facility to distribute the conditioned air accordingly. The conditioned air is discharged from the branch ducting 154 through a plurality of vents 158.

A scent dispersion system 200 is integrated into the air conditioning air handler 110 of the central air conditioning system. The scent dispersion system 200 comprises a scent injection assembly 210, a pressure application conduit 230 and a scent injection conduit 236. The exemplary scent injection assembly 210 includes a scent reservoir 212 and an integrated scent injection body 216, wherein it is preferably that the scent reservoir 212 is removably attached to the integrated scent injection body 216 by any reasonable mechanical interface. The scent reservoir 212 can be fabricated of a translucent or transparent material allowing a service person to view and monitor the remaining volume of a scent generating liquid 260 disposed within the scent injection assembly 210. An exemplary interface utilizes a releasable reservoir coupling 214 comprising a threaded interface. The integrated scent injection body 216 includes an inlet coupler 220 for attachment to the pressure application conduit 230 (or other integrated pressurized component, such as a post valve pressure application conduit 234 as illustrated) and a discharge coupler 224 for attachment to the scent injection conduit 236. An inlet orifice 222 is provided through the inlet coupler 220 for transference of the pressurized airflow from the high pressure section 118 into the scent injection assembly 210. A discharge orifice 226 is provided through the discharge coupler 224 for transference of the scented airflow from the scent injection assembly 210 into the low pressure section 116 for mixing with the conditioned air.

The pressure application conduit 230 obtains pressure from the high pressure section 118, which generates an airflow therethrough. Pressure is applied across a pressure application orifice 232 provided at a first end of the pressure application conduit 230. The pressure generates a pressure airflow 250, which enters the pressure application orifice 232, passes through the pressure application conduit 230 and into the scent injection assembly 210 through an inlet orifice 222. The scent generating liquid 260 steadily vaporizes forming a scent generating vapor 262. The scent generating vapor 262 mixes into the passing airflow forming a scent injection airflow 252, where the scent injection airflow 252 exits the scent reservoir 212, passing through the discharge orifice 226. The scent injection airflow 252 continues traveling along the scent injection conduit 236, exiting through the scent injection orifice 238 to enter into the low pressure section 116 of the air conditioning air handler 110. The scented air mixture combines with the conditioned air to form a scented and conditioned air mixture 254, which is distributed throughout the facility.

An optional scent operation control valve 240 can be inserted into the system segmenting the pressure application conduit 230 into a shortened pressure application conduit 230 and a post valve pressure application conduit 234. The scent operation control valve 240 can be manually operated or automated. The automated control can be operated by a timer controlling circuit, a remote control, a user directed control, a scent management circuit, and the like. The scent management circuit can determine the quantity of scent remaining in the reservoir, the amount of scent residing within the atmosphere within the facility, and the like. Alternately, a scent dispersion flow valve control 228 can be integrated into the scent injection assembly 210 to limit the exposure of the scent generating liquid 260 to the pressure airflow 250. This can include activating and deactivating the scent dispersion system 200.

Figure 4:
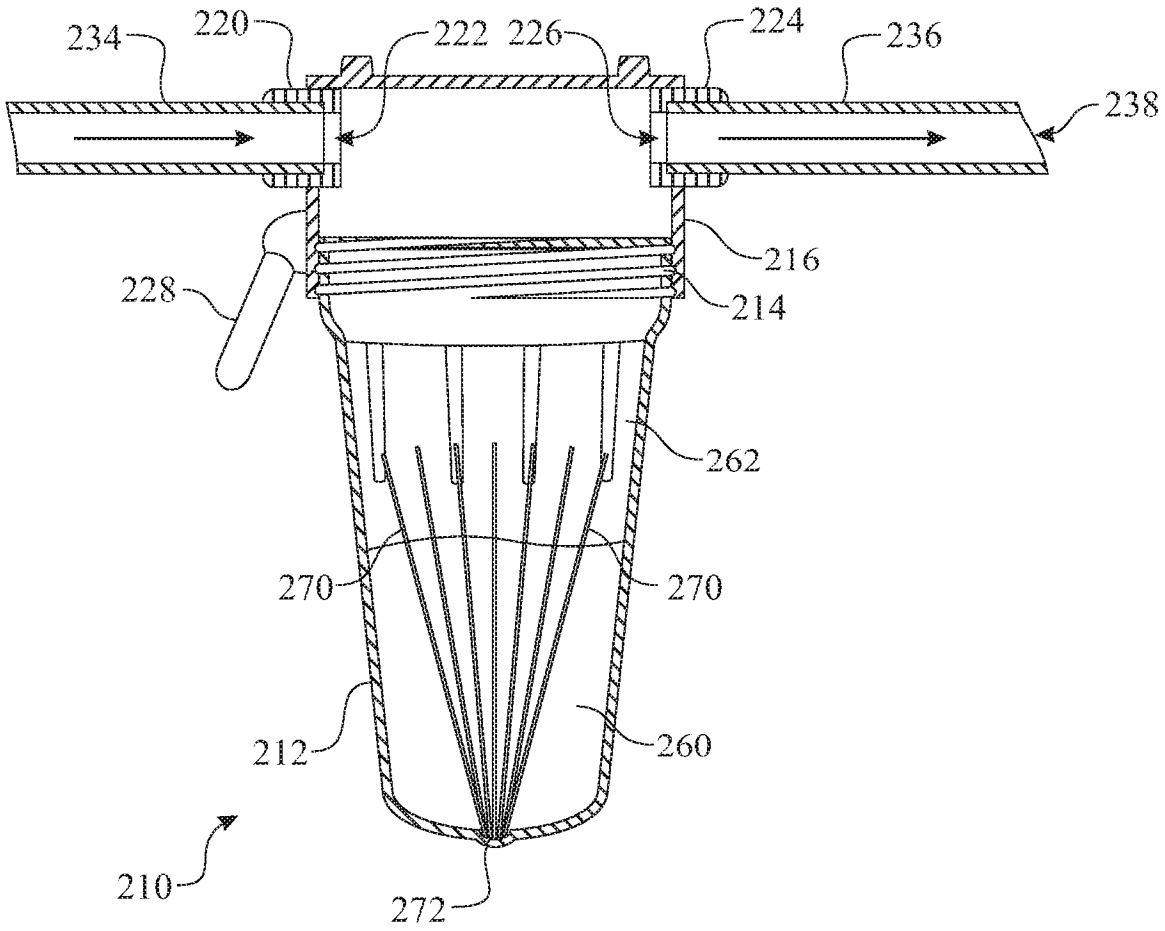
FIG. 4 presents a sectioned elevation view of the scent injection system introducing a plurality of scent reeds.

The vaporization process of the scent injection assembly 210 can be enhanced in any variety of scent enhancing apparatus. The scent enhancing apparatus accelerates a process of converting a scent generating liquid 260 into a scent generating vapor 262. A first exemplary scent enhancing apparatus utilizes a plurality of scent dispersing reeds 270 as illustrated in FIG. 4. The scent dispersing reeds 270 are positioned placing one end of each scent dispersing reed 270 into the scent generating liquid 260 and leaving an opposite end of the scent dispersing reed 270 exposed within the air. An optional reed seating recession 272 can be included within a bottom of the scent reservoir 212. The lower end of the reeds 270 can be positioned in the reed seating recession 272 to direct the reeds into an outward fanning configuration as illustrated. The scent generating liquid 260 is drawn upwards through pores of the scent dispersing reed 270. The rate of evaporation is a function of the surface area between the fluid and the air. The effective surface area is increased as the scent generating liquid 260 is drawn upwards along the reeds using both surface tension and the porosity of the scent dispersing reed 270, thus increasing the effective surface area between the fluid and the surrounding air within the scent injection assembly 210. One of the benefits of the scent dispersing reeds 270 is the lack of any power requirement. The reeds 270 should be replaced on a regular basis, causing some basic maintenance.

Figure 5:
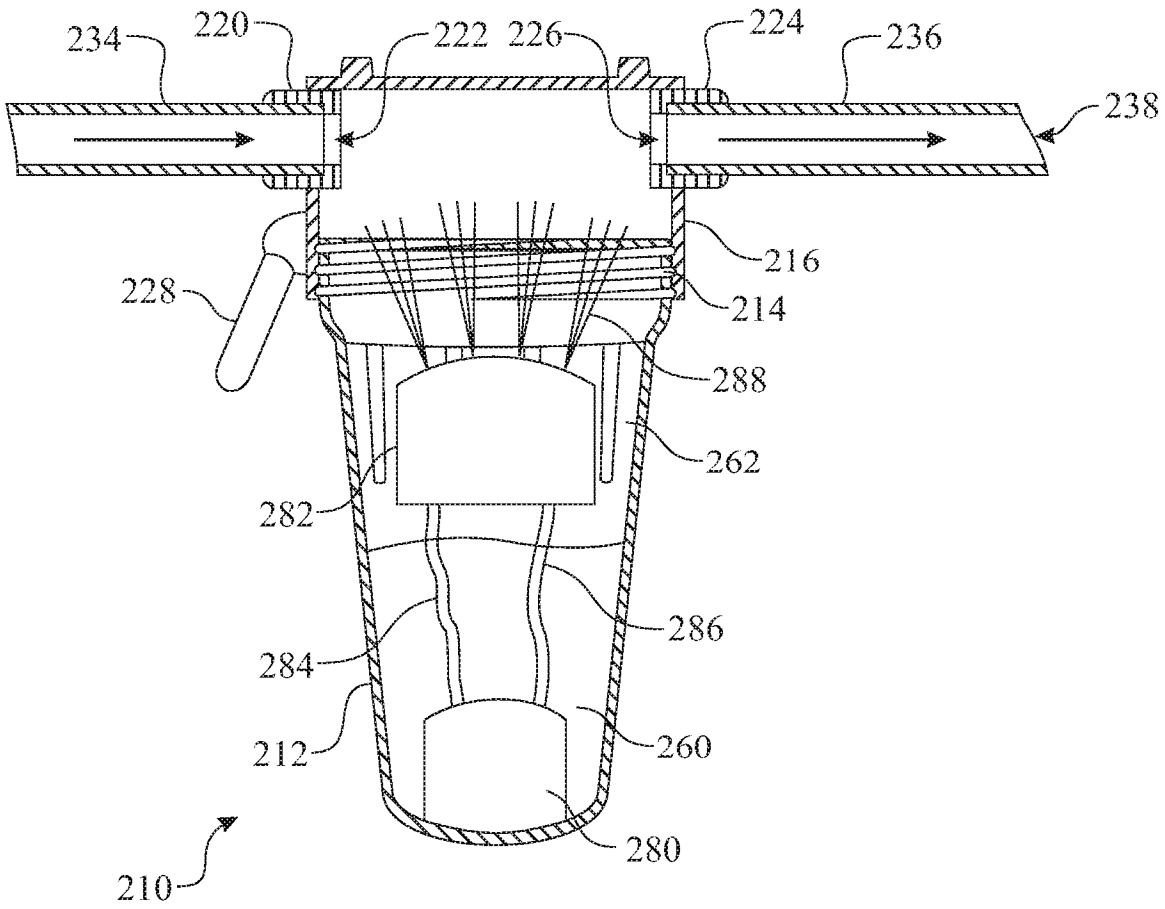
FIG. 5 presents a sectioned elevation view of the scent injection system introducing an ultrasonic scent vaporizing system.

A second exemplary scent enhancing apparatus utilizes an ultrasonic system to vaporize the scent generating liquid 260 as illustrated in FIG. 5. The ultrasonic vaporization system can be of any configuration known by those skilled in the art. The exemplary ultrasonic vaporization system includes an ultrasonic system controller 280 in electric and fluid communication with an ultrasonic scent disbursement head 282. An electrical interface 284 provides electrical communication between the ultrasonic system controller 280 and the ultrasonic scent disbursement head 282. A fluid conduit 286 provides fluid communication between the ultrasonic system controller 280 and the ultrasonic scent disbursement head 282. Power can be provided by a continuous external power source, such as an electrical outlet and a power cord (not shown but well understood) or by utilizing an integrated battery (not shown but well understood). The power can be governed by the same power source controlling the operation of the air conditioning air handler 110. A timer can be included in the power circuit to control the operating vaporization time of the ultrasonic vaporization system. The ultrasonic system controller 280 transfers scent generating liquid 260 from the base of the scent reservoir 212 to the ultrasonic scent disbursement head 282. A controller circuit (not shown, but well known by those skilled in the art) operates the ultrasonic scent disbursement head 282 converting the liquid into a vapor. More specifically, the ultrasonic scent disbursement head 282 converts the scent generating liquid 260 into a vaporized scent 288. The system can be integrated into a single assembly. The system would preferably include a floatation element to maintain a vaporization surface proximate a liquid surface.

Figure 6:
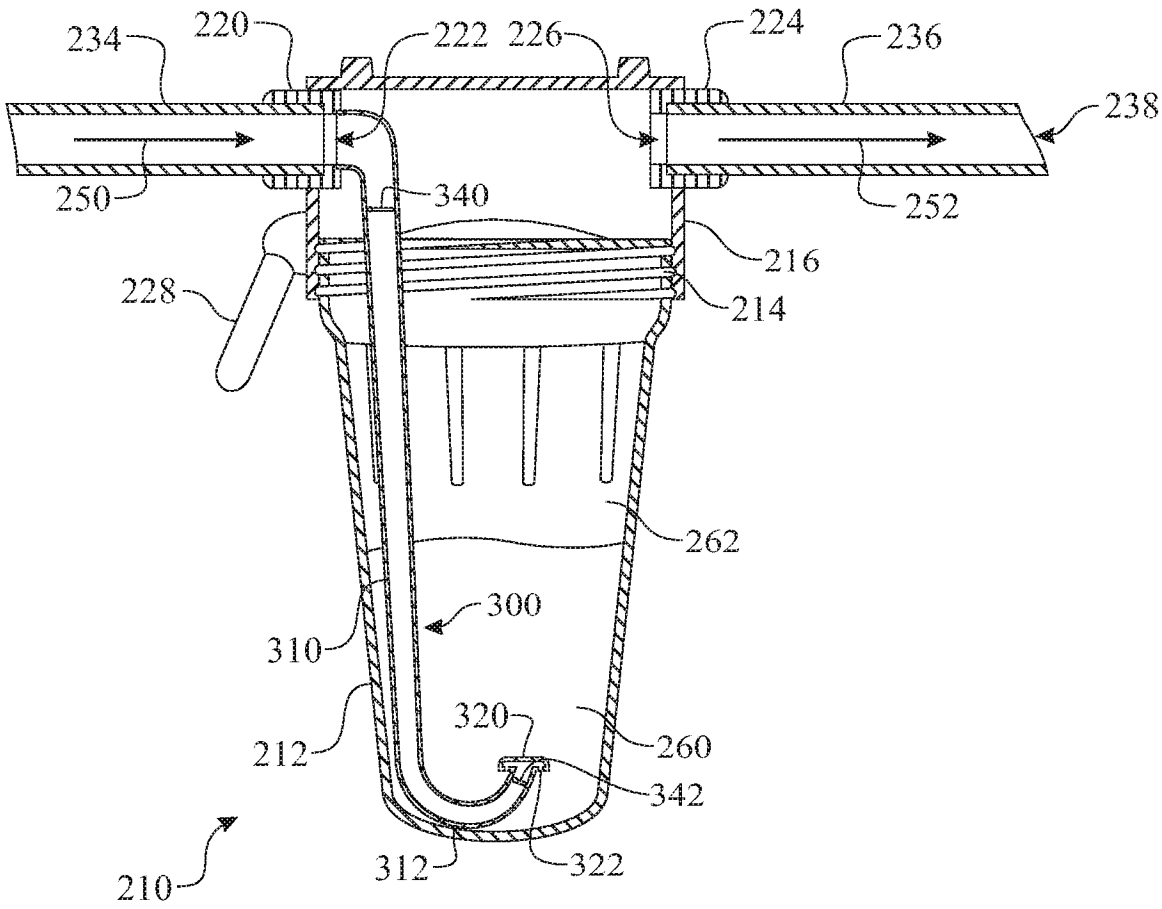
FIG. 6 presents a sectioned elevation view of the scent injection system introducing a first exemplary aerator vaporization assistance system.

A third exemplary scent enhancing apparatus aerates the scent generating liquid 260. The aeration process can be provided by any known by those skilled in the art. A first exemplary aeration system 300 directs the pressure airflow 250 into the scent generating liquid 260 as illustrated in FIG. 6. The pressure airflow 250 is communicated downward via an aerator 300 and discharges into a lower region of the stored volume of scent generating liquid 260. The aerator 300 is fabricated having an aerating conduit 310. The aerating conduit 310 can be of any form factor that discharges the pressure airflow 250 into the scent generating liquid 260. In one form factor, the aerating conduit 310 can be flexible, with the discharge orifice of the aerating conduit 310 being attached to a floatation device, maintaining the discharge orifice at a constant level respective to the scent generating liquid surface. In a second form factor, the aerating conduit 310 can be directed downward, curving upwards at an aerating conduit lower apex 312. A backflow prevention device 320 can be disposed at the discharge orifice. The backflow prevention device 320 redirects the aerator discharge port 322 downward, allowing air pressure to prevent intrusion of the scent generating liquid 260 into the aerating conduit 310. At least one check valve, such as a scent injection assembly upper check valve 340 or a scent injection assembly lower check valve 342 can be integrated into the aerator 300 to further aid in controlling and minimizing any backflow. The pressure airflow 250 discharges from the aerator discharge port 322 into the scent generating liquid 260. The gaseous discharge aerates the scent generating liquid 260. The aeration increases the rate of vaporization of the scent generating liquid 260. The backflow prevention features minimize a need to displace any scent liquid that could have collected within the aerating conduit 310.

Figure 7:
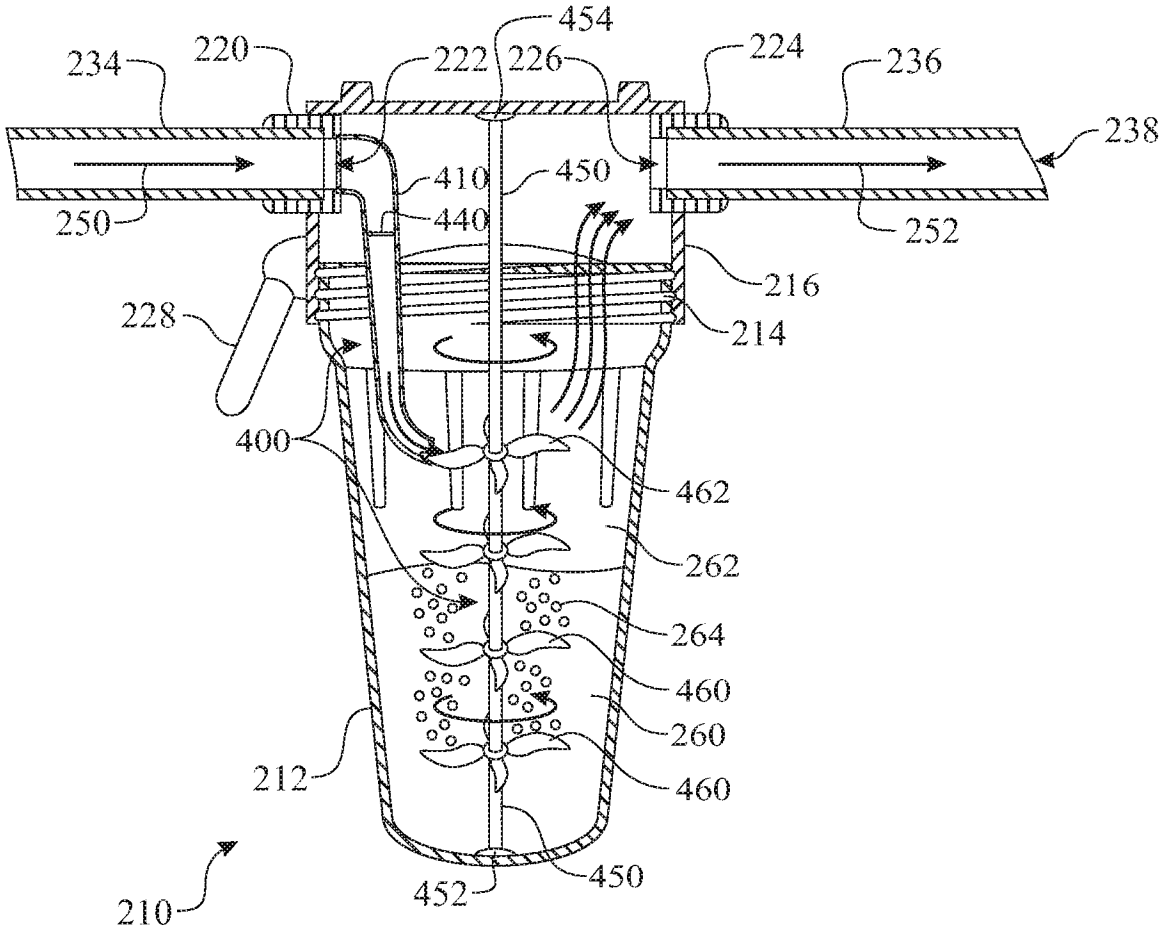
FIG. 7 presents a sectioned elevation view of the scent injection system introducing a second exemplary aerator vaporization assistance system.

A second exemplary aerator 400 utilizes a rotational assembly comprising at least one aerating blade assembly 460 for aerating the scent generating liquid 260 as illustrated in FIG. 7. The aerator 400 comprises an aerating conduit 410 for directing airflow 250 to rotationally drive an aerating assembly. A scent injection assembly upper check valve 440 can be integrated into the aerating conduit 410 to control any potential backflow of the scent generating liquid 260 into the aerating conduit 410. The aerating assembly comprises an aerator shaft 450 rotationally assembled to the scent injection assembly 210 in any reasonably known rotational interface. The exemplary embodiment integrates a lower shaft bearing 452 at a lower end of the aerator shaft 450 and an upper shaft bearing 454 at an upper end of the aerator shaft 450. The lower shaft bearing 452 is positioned against a lower apex of the scent reservoir 212. The upper shaft bearing 454 is located against an interior surface of an upper member of the integrated scent injection body 216, vertically orienting the aerator shaft 450. At least one aerating blade assembly 460 is assembled to the aerator shaft 450. The aerating blade assembly 460 should be balanced about the aerator shaft 450 to avoid any unwarranted vibrations. It is preferred that a plurality of aerating blade assemblies 460 be assembled to the aerator shaft 450 in a spatial arrangement. The lowest aerating blade assembly 460 should be located proximate the bottom of the scent reservoir 212, optimizing the aeration of the scent generating liquid 260. A drive blade assembly 462 is assembled to the aerator shaft 450 at a position to receive pressure airflow 250 from the aerating conduit 410. The pressure airflow 250 passes across the drive blade assembly 462 causing the drive blade assembly 462 to rotate. The rotational motion of the drive blade assembly 462 is transferred to the aerator shaft 450, which rotates the at least one aerating blade assembly 460. The rotational motion of the aerating blade assembly 460 aerates the scent generating liquid 260 creating generated scented air bubbles 264. The generated scented air bubbles 264 rise to the surface and combine with passing airflow, forming the scent injection airflow 252.

Although the primary disclosure presents a scent dispersion system, it is understood that a disinfectant may be utilized ether in place of or in conjunction with the scent generating liquid 260.

The scent dispersion system 200 can be integrated into any air conditioning system, including automotive applications, trains, planes, and the like. The pressure application orifice 232 would be placed in an upstream region of a heat exchanger/air movement fan or blower and the scent injection orifice 238 would be placed in a position downward from the fan, drawing the scented air inward.

Figure 8:
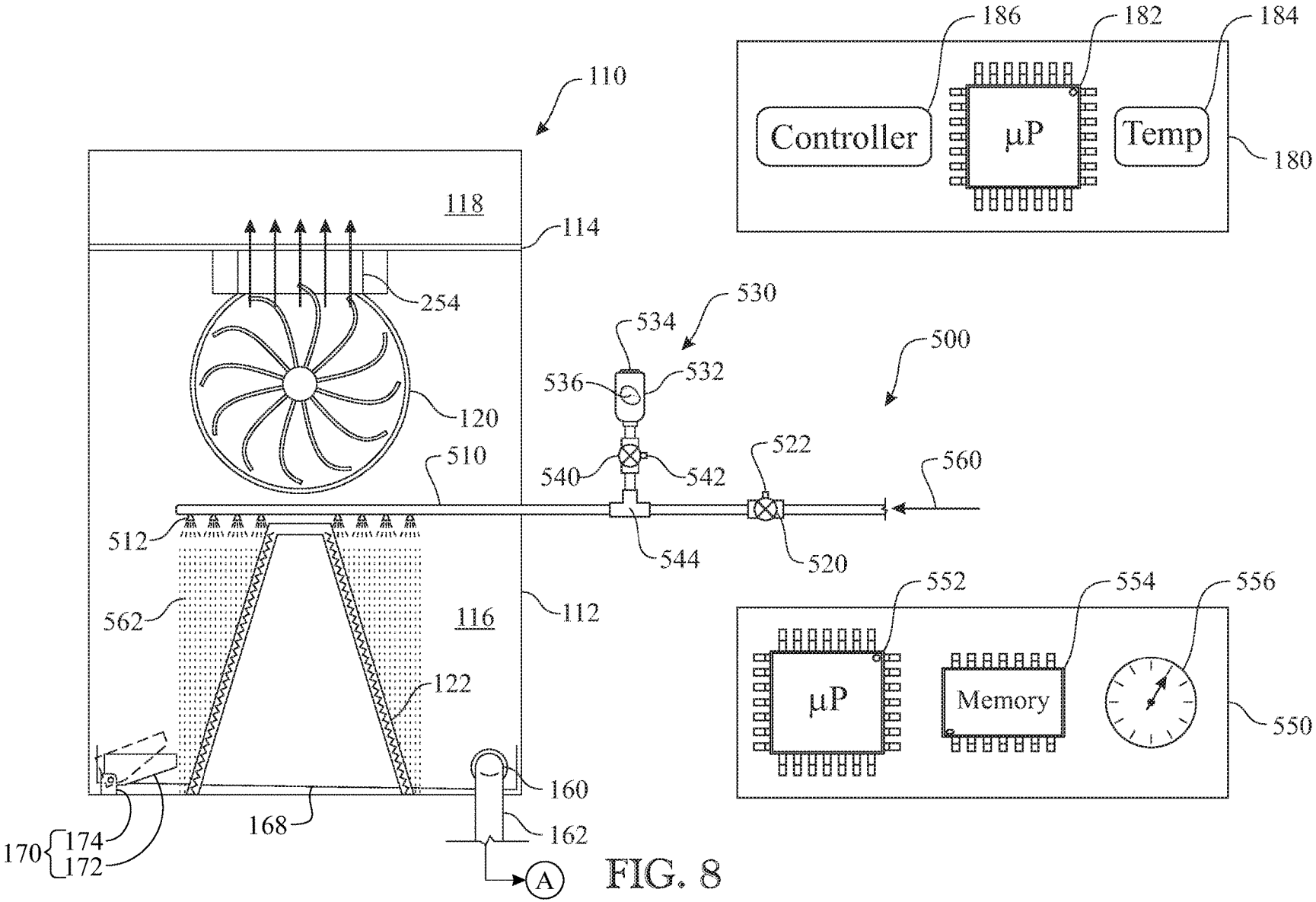
FIG. 8 presents an elevation view of an exemplary central air conditioning system having an air handler heat exchanger rinse system integrated therewith.

The air conditioning air handler 110 includes an air handler heat exchanger 122. Any dust, lint, debris; or other contamination; condensation build up; and the like upon the air handler heat exchanger 122 can affect the efficiency of the air conditioning system 100. A heat exchanger rinse system 500, introduced in FIG. 8, provides an automated rinsing system to remove any dust, lint, debris; or other contamination; condensation build up; and the like from the air handler heat exchanger 122. The heat exchanger rinse system 500 delivers a rinsing fluid (represented by an arrow as the flow from a rinse cleaning composition delivery system 530) to the air handler heat exchanger 122. In the exemplary embodiment, the heat exchanger rinse system 500 includes a heat exchanger rinse fluid delivery conduit 510 configured to transfer the rinsing fluid from a heat exchanger rinse fluid source 560 to at least one heat exchanger rinse fluid delivery component 512 assembled to a delivery end of the heat exchanger rinse fluid delivery conduit 510. A heat exchanger rinse supply flow control valve 520 is installed at a location along the heat exchanger rinse fluid delivery conduit 510 between the heat exchanger rinse fluid source 560 and the heat exchanger rinse fluid delivery component 512. The heat exchanger rinse supply flow control valve actuator 522 controls the operation of the heat exchanger rinse supply flow control valve 520. Operation of the heat exchanger rinse supply flow control valve 520 enables and disables flow between the heat exchanger rinse fluid source 560 and the heat exchanger rinse fluid delivery component 512. Operation of the heat exchanger rinse supply flow control valve 520 can be provided by an air handler heat exchanger rinse system controller circuit 550. The air handler heat exchanger rinse system controller circuit 550 could operate independently or in conjunction with an air conditioning thermostat 180.

The air handler heat exchanger rinse system controller circuit 550 would preferably include a microprocessor 552, a non-volatile digital memory 554 in signal communication with the microprocessor 552, and a clocking circuit 556 in signal communication with the microprocessor 552. The microprocessor 552 would operate in accordance to an instruction set, wherein the instruction set would be resident on either the microprocessor 552 or the non-volatile digital memory 554. The clocking circuit 556 provides digital clocking or timing information to the microprocessor 552.

The air conditioning thermostat 180 would preferably include an air conditioning thermostat microprocessor 182, an air conditioning thermostat thermometer 184 in signal communication with the air conditioning thermostat microprocessor 182, and an air conditioning thermostat system controller 186 in signal communication with the air conditioning thermostat microprocessor 182 and the operating components of the air conditioning system 100. The air conditioning thermostat microprocessor 182 would operate in accordance to an instruction set, wherein the instruction set would be resident on either the air conditioning thermostat microprocessor 182 or a non-volatile digital memory device (not shown).

The air handler heat exchanger rinse system controller circuit 550 can be configured to receive signals from the air conditioning thermostat 180 and direct actions based upon the signals received from the air conditioning thermostat 180.

An optional rinse cleaning composition delivery system 530 can be integrated into the heat exchanger rinse system 500. The rinse cleaning composition delivery system 530 would preferably be configured to inject a chemical cleaning composition 536 into the rinse fluid during the rinsing cycle. The rinse cleaning composition delivery system 530 would be located along the heat exchanger rinse fluid delivery conduit 510 between the sourcing end of the heat exchanger rinse fluid delivery conduit 510 and the delivery end of the heat exchanger rinse fluid delivery conduit 510. In the exemplary configuration, the rinse cleaning composition delivery system 530 is located between the heat exchanger rinse supply flow control valve 520 and the delivery end of the heat exchanger rinse fluid delivery conduit 510.

The rinse cleaning composition delivery system 530 would include a rinse cleaning composition reservoir 532 for containing a volume of the chemical cleaning composition 536. Access to the rinse cleaning composition reservoir 532 can be provided by an aperture, wherein the aperture would be accessed and sealed by a rinse cleaning composition reservoir fill cap 534. A rinse cleaning composition supply valve 540 would be integrated between the rinse cleaning composition reservoir 532 and the heat exchanger rinse fluid delivery conduit 510, wherein the rinse cleaning composition supply valve 540 governs retention and delivery of the chemical cleaning composition 536 within and from, respectively, into the heat exchanger rinse system 500. The rinse cleaning composition supply valve 540 would be operated in accordance with a signal provided to a rinse cleaning composition supply valve actuator 542. A rinse cleaning composition supply valve coupling element 544, such as a piping T, can be included to place the rinse cleaning composition supply valve 540 in fluid communication with the heat exchanger rinse fluid delivery conduit 510.

Figure 9:
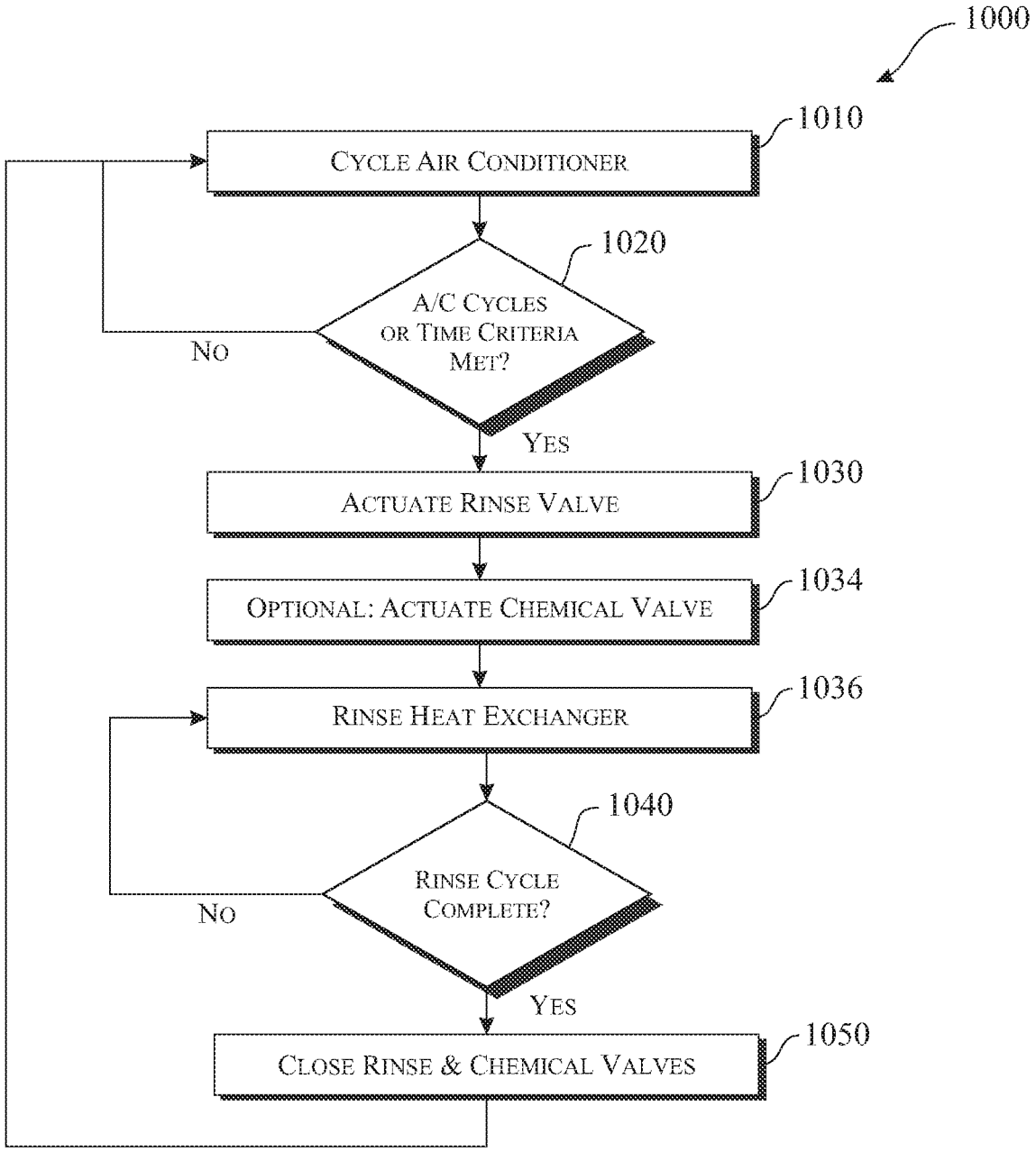
FIG. 9 presents a flow diagram describing an exemplary method of using the air handler heat exchanger rinse system.

An exemplary operation of the heat exchanger rinse system 500 is described in an air handler heat exchanger rinse process 1000 presented in FIG. 9. The process initiates with a cycling of the air conditioner (step 1010). The air conditioner would turn on when the area reaches a predetermined temperature, run to either cool or heat the area, then when the area reaches a predetermined temperature, turn off. When cooling, the air conditioner would turn on when the room temperature reaches a preset high temperature setting and would turn off when the when the room temperature reaches a preset low temperature setting. Conversely, when heating, the air conditioner would turn on when the room temperature reaches a preset low temperature setting and would turn off when the when the room temperature reaches a preset high temperature setting.

The air handler heat exchanger rinse system controller circuit 550 would be programmed to activate the system based upon any of a variety of conditions (decision step 1020). In one exemplary condition, the air handler heat exchanger rinse system controller circuit 550 would activate the system based upon a predetermined number of operating cycles of the air conditioning system 100. The cycles would be identified by a communication link between the air handler heat exchanger rinse system controller circuit 550 and the air conditioning thermostat 180. The air handler heat exchanger rinse system controller circuit 550 can be programmed to activate the system 500 after each cycle, after every other cycle, after any predetermined quantity of cycles, or randomly. In a second exemplary condition, the air handler heat exchanger rinse system controller circuit 550 would activate the system 500 based upon a predetermined time span, such as once a day, once every other day, once every predetermined number of days, once a week, once every two weeks, once a month, once every other month, randomly, or any other suitable setting. In a third exemplary condition, the air handler heat exchanger rinse system controller circuit 550 would activate the system 500 based upon a predetermined number of operating cycles of the air conditioning system 100 and based upon a predetermined time span, whichever is shorter or whichever is longer, all dependent upon the user's desired settings.

Upon activation of the heat exchanger rinse system 500, the air handler heat exchanger rinse system controller circuit 550 would transmit an actuation signal to the heat exchanger rinse supply flow control valve actuator 522 to actuate the heat exchanger rinse supply flow control valve 520. The heat exchanger rinse supply flow control valve 520 would move into an open state (step 1030), allowing flow of rinse fluid from a heat exchanger rinse fluid source 560 to a delivery end of the heat exchanger rinse fluid delivery conduit 510. The rinse fluid would be dispensed onto the air handler heat exchanger 122 through the at least one heat exchanger rinse fluid delivery component 512, referenced as a heat exchanger rinse application 562 (step 1036).

The heat exchanger rinse system 500 can include an optional rinse cleaning composition delivery system 530. The air handler heat exchanger rinse system controller circuit 550 can direct the rinse cleaning composition delivery system 530 to dispense and introduce a chemical cleaning composition 536 into the rinse fluid by actuating or opening the rinse cleaning composition supply valve 540 (step 1034). The air handler heat exchanger rinse system controller circuit 550 would transmit an actuation signal to the rinse cleaning composition supply valve actuator 542 to actuate the rinse cleaning composition supply valve 540. Operation of the rinse cleaning composition supply valve 540 can be determined by a programming of the air handler heat exchanger rinse system controller circuit 550. In one example, operation of the rinse cleaning composition supply valve 540 can synchronized with the operation of the heat exchanger rinse supply flow control valve 520. The rinse cleaning composition supply valve 540 can be closed prior to the closure of the heat exchanger rinse supply flow control valve 520 enabling the rinse fluid to rinse off any of the applied chemical cleaning composition 536. In a second example, operation of the rinse cleaning composition supply valve 540 can based upon a cycle count of the operation of the heat exchanger rinse supply flow control valve 520. The cycle count can be each operation of the heat exchanger rinse supply flow control valve 520, every other operation of the heat exchanger rinse supply flow control valve 520, or every nth operation of the heat exchanger rinse supply flow control valve 520. Alternatively, operation of the rinse cleaning composition supply valve 540 can be based upon a predetermined time span, such as once a day, once every other day, once every predetermined number of days, once a week, once every two weeks, once a month, once every other month, randomly, or any other suitable setting. The rinse cleaning composition delivery system 530 can include a device to monitor the stored volume or inventory of the chemical cleaning composition 536. The air handler heat exchanger rinse system controller circuit 550 can include an indicator to identify when the volume or inventory of the chemical cleaning composition 536 reaches a predetermined level to inform a service person of a need to replenish the chemical cleaning composition 536 within the rinse cleaning composition reservoir 532. The chemical cleaning composition 536 can include a bleach based composition, an antibacterial element, an antifungal element, and the like.

The heat exchanger rinse system 500 would apply the rinse fluid (with or without the chemical cleaning composition 536) until the air handler heat exchanger rinse system controller circuit 550 determines the rinse cycle is complete (decision step 1040). This can be based upon a pre-established time period, a volume of applied rinse fluid, monitoring clarity of the rinse fluid discharged from the air handler heat exchanger 122, and the like. Once the air handler heat exchanger rinse system controller circuit 550 determines that the rinse cycle is complete (decision step 1040), the air handler heat exchanger rinse system controller circuit 550 deactuates or closes the heat exchanger rinse supply flow control valve 520 and, when applicable, the rinse cleaning composition supply valve 540. The heat exchanger rinse application 562 would be collected in the condensation collection tray 168 located at the base of the air handler housing 112 and drain through the air handler drain pipe 162. During the rinse process, the air handler heat exchanger rinse system controller circuit 550 would direct the air conditioning thermostat 180 to maintain the air conditioning system 100 in an inactive state. Upon completion of the rinse process, the system returns the air conditioning system 100 to a standard operating mode.

Condensation generated during operation of the air conditioning air handler 110 is collected by a condensation collection element, such as a condensation collection tray 168. The collected condensation 801 (FIGS. 10-14) is discharged through an air handler drain pipe 162. The air handler drain pipe 162 is assembled to the air conditioning air handler 110 by an air handler drain pipe connector 160. The air handler drain pipe 162 is known to become clogged over time. Debris, lint, organic growth, and the like can accumulate within the air handler drain pipe 162 over time, creating an air handler condensation drain pipe blockage 899. An automated air handler drain pipe flush system 600 is adapted to dislodge blockages 899 formed within the air handler drain pipe 162, as illustrated in FIGS. 10 through 14. The air handler condensation drain pipe blockage 899 can block flow of collected condensation 801 discharged from air handler 110.

The automated air handler drain pipe flush system 600 includes a float valve actuator assembly 700 inserted in fluid communication between the air handler drain pipe 162 and a series of piping sections forming a downstream portion of an air handler drain pipe 610, 612, 614, 616. A flush fluid supply system (a flush fluid supply source 850 of FIG. 10) is integrated into the downstream portion of the air handler drain pipe 610, 612, 614, 616, wherein the flush fluid supply system delivers a volume and flow of a flush fluid 841 (stationary fluid provided by the flush fluid supply line source 850 (FIG. 11) and flowing flush fluid 841 provided by the flush supply line source flow 840 (FIG. 13)) into the downstream portion of the air handler drain pipe 610, 612, 614, 616, preferably at a location proximate an outlet (referenced as a float switch discharge coupler 728) of the float valve actuator assembly 700. The injection point of the flush fluid supply system is preferably located at a location that would be downstream or following of a check valve (provided by float element 730 engaging and disengaged with a float valve ring seal 715 located within the float valve actuator enclosure 710) and upstream or prior to any air handler condensation drain pipe blockage 899 (introduced in FIG. 11).

In more detail, the float valve actuator assembly 700 includes a float assembly 730, 732, 734 configured to act as a valve (as shown) or actuate a valve (understood by description). The float assembly can include a float element 730, a float actuator column 732 extending radially or vertically upward from the float element 730, and a float actuator plate 734 adapted to engage with an operate a float operated switch 740. A float valve seal 715 or in the illustrative example, a float valve ring seal 715 is supported by a float valve ring 714. The float valve ring 714 is a solid ring extending radially inward from an interior sidewall of the float valve actuator enclosure 710. A float valve ring seal 715 is formed circumscribing an interior circumference of the ring formed by the float valve ring 714. The float valve ring seal 715 and the float valve ring 714 are designed to create a fluid impervious seal when the float element 730 is seated against the float valve ring seal 715. A float valve lower control arm 716 and a float valve upper control arm 718 extend radially outward from the interior sidewall of the float valve actuator enclosure 710. A float valve lower control arm guide aperture 717 is formed through the float valve lower control arm 716. Similarly, a float valve upper control arm guide aperture 719 is formed through the float valve upper control arm 718. The float valve lower control arm guide aperture 717 and the float valve upper control arm guide aperture 719 are located to be in vertical registration with the float actuator column 732. It is preferred that the float valve lower control arm guide aperture 717, the float valve upper control arm guide aperture 719, and the float actuator column 732 be located centrally through an opening defined by the float valve ring seal 715. The float valve upper control arm 718 can be located above the air handler drain pipe 162, and provide a fluid impervious seal, protecting the float operated switch 740 from contact with water.

A float body support member 712 can extend upward from a lower surface of the float valve actuator enclosure 710 (as shown) or radially inward from the interior sidewall of the float valve actuator enclosure 710. A float body support member contact surface 713 is formed about an upper surface of the float body support member 712, wherein the float body support member contact surface 713 is adapted to support the float element 730 during draining flow of collected condensation 801 from the air conditioning air handler 110, through the air handler drain pipe 162. The float body support member 712 would be designed to allow passage of the draining collected condensation 801 (provided from air handler condensation source flow 800) from the air handler drain pipe 162, through the float body support member 712 (air handler condensation float valve bypass flow 802) and to the air handler drain pipe 610.

Figure 10:
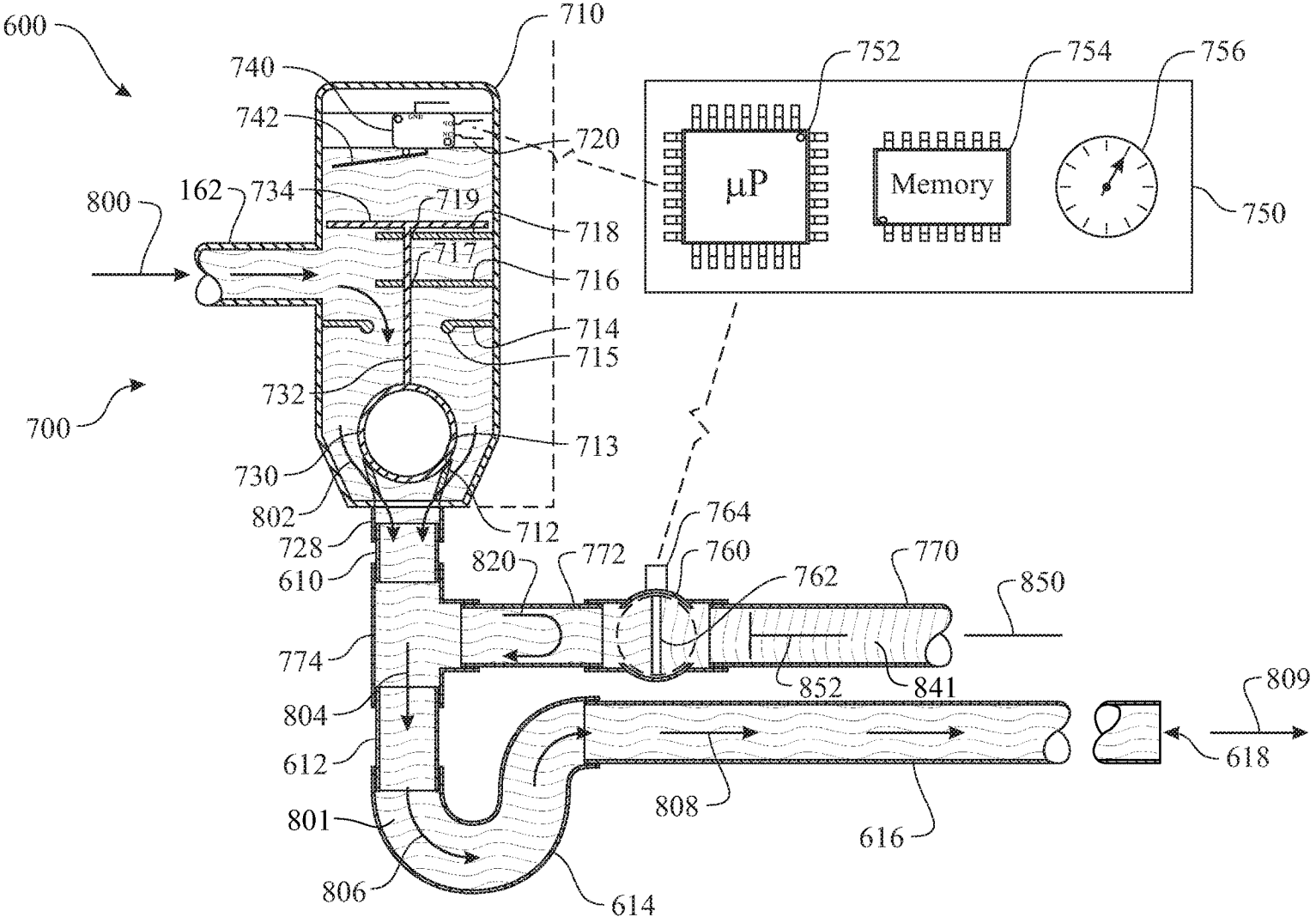
FIG. 10 presents a sectioned elevation view of an exemplary automated air handler drain pipe flush system, the illustration presenting a configuration having the air conditioning system in a normal operating condition and the drain pipe flush system being shown in a standby mode.

During normal, unblocked flow, as illustrated in FIG. 10, the draining collected condensation 801 would continue to flow from the upstream drain connection pipe section 610, through the flush fluid supply system connecting adapter 774 into the downstream drain connection pipe section 612 (air handler condensation pre-J trap drain flow 804), about the J trap drain pipe section 614 (air handler condensation J trap drain flow 806), through the downstream drain pipe section 616 (air handler condensation post J trap drain flow 808) and discharging as an air handler condensation drain discharge flow 809 to a distal drain discharge location or a drain pipe distal end 618. A portion of the draining collected condensation 801 might attempt to flow into the downstream flush fluid supply pipe 772, but would be blocked (air handler flush valve drain flow return 820).

The flush fluid supply pipe 770, 772 injects a flush fluid from a flush fluid supply line source 850 into the air handler drain pipe 610, 612, 614, 616. An air handler drain pipe flush supply flow control valve 760 is assembled between the upstream flush fluid supply pipe 770 and the downstream flush fluid supply pipe 772. The air handler drain pipe flush supply flow control valve 760 controls the flow of the flush fluid 841 from the flush fluid supply line source 850 into the air handler drain pipe 610, 612, 614, 616. An air handler drain pipe flush supply flow control valve operating element 762 of the air handler drain pipe flush supply flow control valve 760 is toggled between a closed configuration and an open configuration by a signal provided from an air handler drain pipe flush supply flow controller circuit 750 to an air handler drain pipe flush supply flow control valve controller 764.

The air handler drain pipe flush supply flow controller circuit 750 controls the operation of the automated air handler drain pipe flush system 600. The air handler drain pipe flush supply flow controller circuit 750 is similar to the air handler heat exchanger rinse system controller circuit 550. The air handler drain pipe flush supply flow controller circuit 750 includes a microprocessor 752, a non-volatile digital memory device 754 in digital signal communication with the microprocessor 752, and a clocking circuit 756 in digital signal communication with the microprocessor 752.

In one configuration, the air handler drain pipe flush supply flow controller circuit 750 can be in digital signal communication with the float operated switch 740 to utilize the float valve actuator assembly 700 to determine when to utilize the automated air handler drain pipe flush system 600. The float switch 740 can be mounted to a float switch mount 720 within the float valve actuator enclosure 710, or external to the float valve actuator enclosure 710, with the float switch actuator arm 742 being in operational engagement with the float actuator plate 734. The float element 730 would rise upward when an air handler condensation drain pipe blockage 899 forms within the air handler drain pipe 610, 612, 614, 616. The draining collected condensation 801 would back up, lifting the float element 730. The lifted float element 730 would engage with and move the float switch actuator arm 742, which would actuate the float operated switch 740, toggling an electrical state from a closed circuit to an open circuit or an open circuit to a closed circuit. The change in state of the switch is monitored by the microprocessor 552 of the air handler heat exchanger rinse system controller circuit 550. The air handler heat exchanger rinse system controller circuit 550 would act accordingly. In a second configuration, the air handler drain pipe flush supply flow controller circuit 750 can be in digital signal communication with the air handler float switch assembly 170 to determine when to utilize the automated air handler drain pipe flush system 600. The float element of the air handler float switch assembly 170 would rise as condensation is collected on the condensation collection tray 168 located at the base of the air conditioning air handler 110 and lower when condensation is discharged from the condensation collection tray 168. The electrical state provided by the float operated switch within the air handler float switch assembly 170 would toggle from a closed circuit to an open circuit or an open circuit to a closed circuit. The change in state of the float operated switch is monitored by the microprocessor 552 of the air handler heat exchanger rinse system controller circuit 550. The air handler heat exchanger rinse system controller circuit 550 would act accordingly. In another configuration, the air handler drain pipe flush supply flow controller circuit 750 can be in digital signal communication with the air conditioning thermostat 180 to utilize cycles of the air conditioning system 100 to determine when to cycle the automated air handler drain pipe flush system 600. In this configuration, the air handler drain pipe flush supply flow controller circuit 750 would operate in a manner similar to the way the air handler heat exchanger rinse system controller circuit 550 operates as described above.

An example of a method of operation of the automated air handler drain pipe flush system 600 is illustrated in FIGS. 10 through 14. The automated air handler drain pipe flush system 600 is shown in a normal operating configuration in FIG. 10. The float element 730 is seated upon the float body support member contact surface 713. Collected condensation 801 creates an air handler condensation source flow 800, which flows from the air conditioning air handler 110 into the air handler drain pipe 162, shown by link A as a continuation from the section of air handler drain pipe 162 shown in each of FIGS. 1, 2 and 8. The air handler condensation source flow 800 continues flowing through the float valve actuator assembly 700, transferring from the float valve actuator enclosure 710 to the air handler drain pipe 610, 612, 614, 616. More specifically, the collected condensation 801 flows through passageways formed within the float body support member 712 (identified as an air handler condensation float valve bypass flow 802), passing across the flush fluid supply system connecting adapter 774 (identified as an air handler condensation pre-J trap drain flow 804), continuing through the J trap drain pipe section 614 (identified as an air handler condensation J trap drain flow 806), through the downstream drain pipe section 616 (identified as an air handler condensation post J trap drain flow 808), and discharging at a distal opening of the downstream drain pipe section 616 as an air handler condensation drain discharge flow 809. Any collected condensation 801 attempting to flow through the downstream flush fluid supply pipe 772 would be blocked (identified as an air handler flush valve drain flow return 820) by the air handler drain pipe flush supply flow control valve operating element 762 of the air handler drain pipe flush supply flow control valve 760 oriented into a closed configuration. The flush fluid supply line source 850 is also blocked by the air handler drain pipe flush supply flow control valve operating element 762 of the air handler drain pipe flush supply flow control valve 760 oriented into a closed configuration (identified as a blocked flush fluid supply line source 852).

Figure 11:
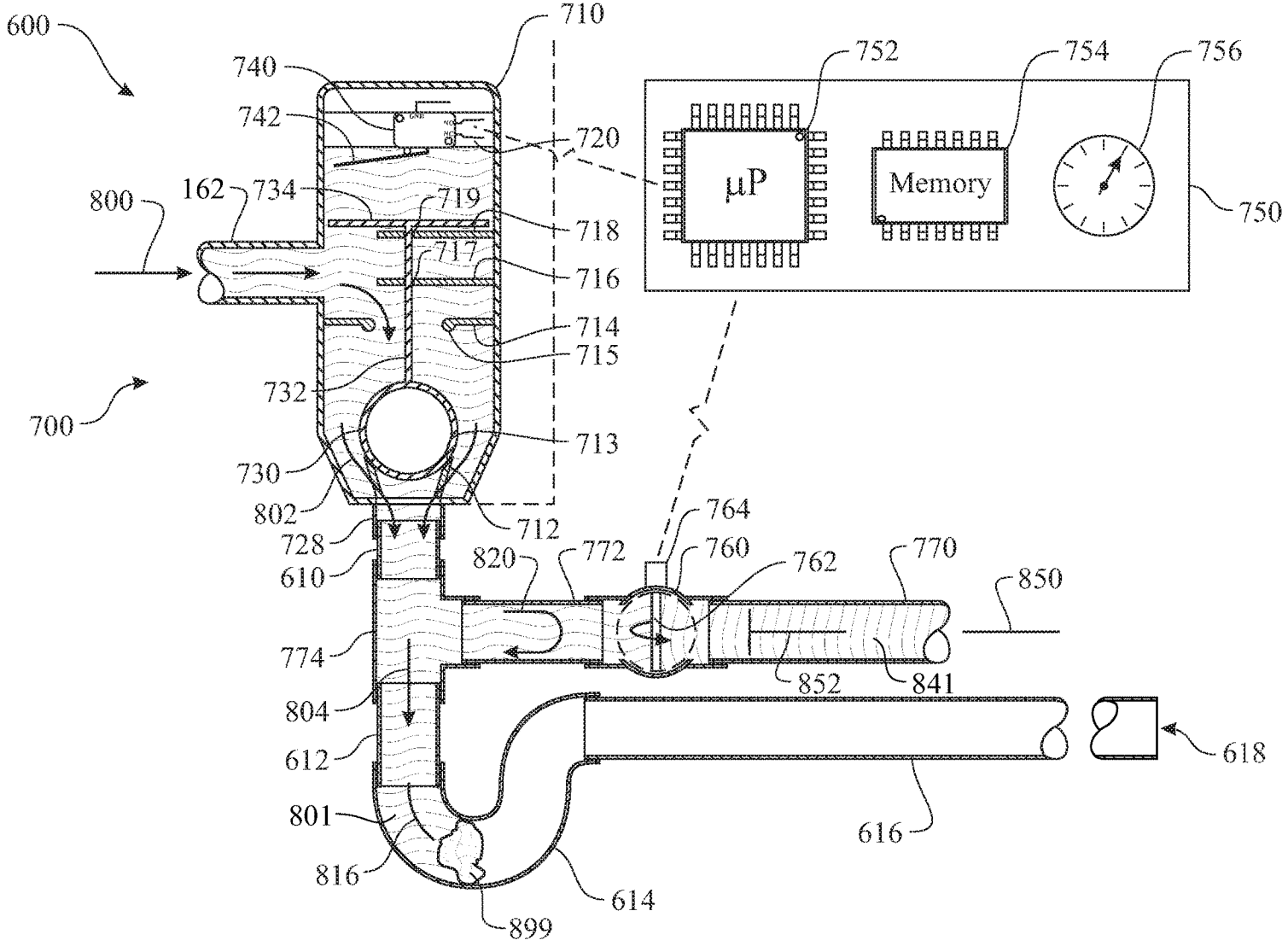
FIG. 11 presents a sectioned elevation view of the exemplary automated air handler drain pipe flush system, the illustration presenting a configuration having an initial blockage in the air handler drain pipe and the drain pipe flush system being shown in a standby mode.

The automated air handler drain pipe flush system 600 is shown having an air handler condensation drain pipe blockage 899 blocking any flow of draining collected condensation 801 in FIG. 11. The exemplary automated air handler drain pipe flush system 600 includes a J trap drain pipe section 614. The inclusion of the J trap drain pipe section 614 is designed to attempt to trap any air handler condensation drain pipe blockage 899 therein. It is noted that the air handler condensation drain pipe blockage 899 can be lodged anywhere along a length of the air handler drain pipe 610, 612, 614, 616, with or without the J trap drain pipe section 614. Once the air handler condensation drain pipe blockage 899 collects enough debris or other contaminants to block the flow of draining collected condensation 801, the flow of collected condensation 801 stops, as illustrated by an air handler condensation J trap drain flow stoppage 816.

Figure 12:
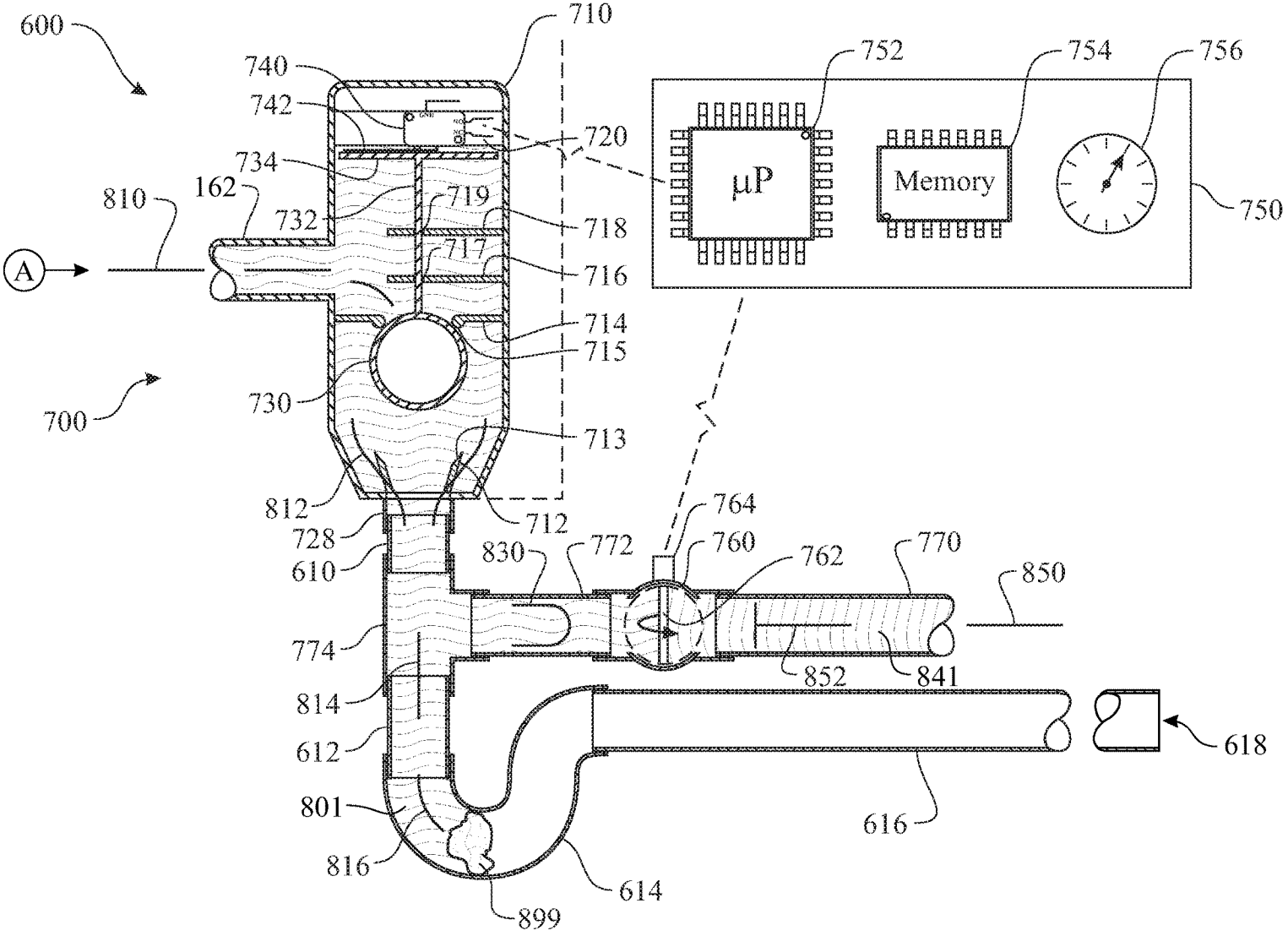
FIG. 12 presents a sectioned elevation view of the exemplary automated air handler drain pipe flush system, the illustration presenting a configuration having the blockage in the air handler drain pipe, a float valve transitioned from an open condition to a closed condition, and the drain pipe flush system being shown transitioning from a standby mode into a flush mode.

The blocked flow (identified by an air handler condensation drain discharge flow stoppage 810, air handler condensation float valve bypass flow stoppage 812, air handler condensation pre-J trap drain flow stoppage 814, and the air handler condensation J trap drain flow stoppage 816) would collect the draining collected condensation 801 in the air handler drain pipe 610, 612, 614 upstream of the air handler condensation drain pipe blockage 899, as illustrated in FIG. 12. A portion of the draining collected condensation 801 might be collected within the downstream flush fluid supply pipe 772 (referred to as an air handler flush valve drain flow return stoppage 830).

The collecting draining condensation 801 would raise the float element 730. The rising float element 730 would contact the float switch actuator arm 742 and actuate the float operated switch 740, toggling the associated electrical switch therein. The toggled electrical state of the float operated switch 740 would signal the air handler drain pipe flush supply flow controller circuit 750 to activate the air handler drain pipe flush supply flow control valve controller 764. The activated air handler drain pipe flush supply flow control valve controller 764 would rotate the air handler drain pipe flush supply flow control valve operating element 762 from a closed configuration (FIG. 12) into an open configuration (FIG. 13), as indicated by the rotating arrow in FIG. 12.

Once the air handler drain pipe flush supply flow control valve 760 is actuated and placed into an open configuration (FIG. 13), the flush supply line source flow 840 supplies a pressure created by a volume and flow of a flush fluid 841 from the upstream flush fluid supply pipe 770 (identified as a flush supply line upstream flow 842), through the air handler drain pipe flush supply flow control valve 760, continuing through the downstream flush fluid supply pipe 772 (identified as a flush supply line downstream flow 843), diverging at the flush fluid supply system connecting adapter 774 in an upstream flow (identified as a flush valve actuating flow 845) and a downstream flow (identified as a flush pre-J trap drain flow 844) to the downstream drain connection pipe section 612 (identified as a flush J trap drain flow 846), through the J trap drain pipe section 614 (identified as a flush J trap drain flow 846) and through the downstream drain pipe section 616 (identified as a flush post J trap drain flow 848) forcing the air handler condensation drain pipe blockage 899 downward along the air handler piping 610, 612, 614, 616 until the air handler condensation drain pipe blockage 899 is forced out thereof.

The air handler drain pipe flush supply flow controller circuit 750 can cycle the air handler drain pipe flush supply flow control valve 760 to determine if the air handler condensation drain pipe blockage 899 has been dislodged. In a condition where flow from the flush supply line source flow 840 ceases and the air handler condensation drain pipe blockage 899 remains, the entrapped volume of flush fluid 841 would retain the float element 730 in a sealed state, retaining the electrical state of the float operated switch 740. Alternatively, in a condition where flow from the flush supply line source flow 840 ceases and the air handler condensation drain pipe blockage 899 is substantially dislodged, the entrapped volume of flush fluid 841 would flow outward from the downstream drain pipe section 616, removing the floating support of the float element 730, toggling the electrical state of the float operated switch 740. The air handler drain pipe flush supply flow controller circuit 750 would monitor the state of the float operated switch 740 to determine if the air handler condensation drain pipe blockage 899 has been dislodged. If the air handler condensation drain pipe blockage 899 has not been dislodged, the air handler drain pipe flush supply flow controller circuit 750 would reactuate the air handler drain pipe flush supply flow control valve 760, opening the air handler drain pipe flush supply flow control valve operating element 762 to repeat the flush cycle. If the air handler condensation drain pipe blockage 899 has been dislodged, the air handler drain pipe flush supply flow controller circuit 750 would return to a blockage monitoring state.

Figure 14:
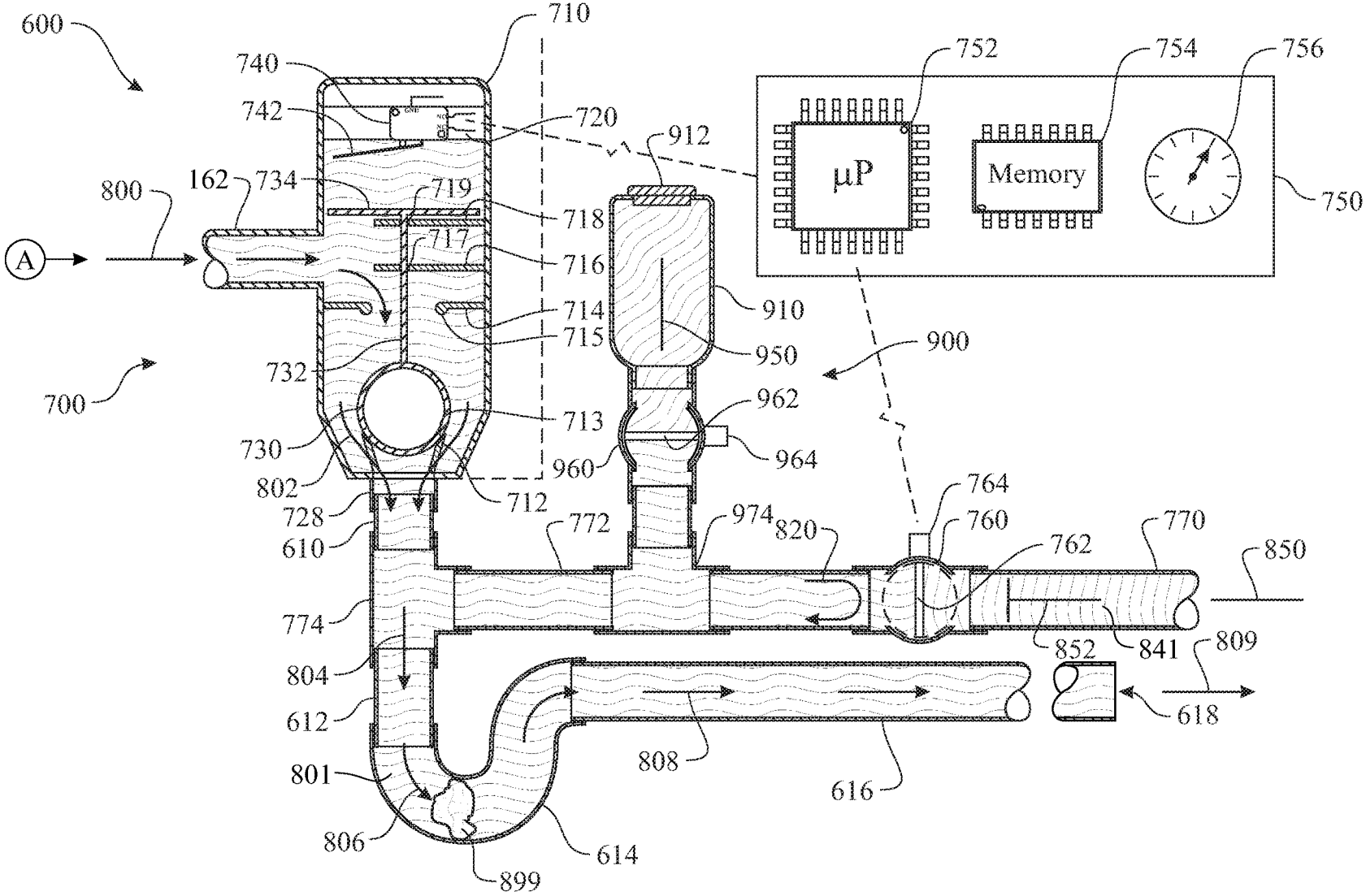
FIG. 14 presents a sectioned elevation view of an exemplary enhanced automated air handler drain pipe flush system, wherein the enhanced automated air handler drain pipe flush system further comprises a chemical cleaning composition injection system.

The automated air handler drain pipe flush system 600 can optionally include a chemical composition injection system 900, as illustrated in FIG. 14. The chemical composition injection system 900 is similar to the rinse cleaning composition delivery system 530 of the heat exchanger rinse system 500. The chemical composition injection system 900 would be adapted to inject a flush assisting chemical composition 950 into the flush fluid 841 through a chemical composition injection system coupling T 974 or any other similar adaptor. The chemical composition injection system coupling T 974 would preferably be located between the air handler drain pipe flush supply flow control valve 760 and the flush fluid supply system connecting adapter 774 to ensure that the flush assisting chemical composition 950 is injected into the air handler drain pipe 610, 612, 614, 616 at a location within prior to the air handler condensation drain pipe blockage 899 so the flush fluid supply line source 850 can provide the proper affect to the air handler condensation drain pipe blockage 899. A volume of the flush assisting chemical composition 950 can be stored within a chemical composition container 910. Access to fill the chemical composition container 910 would be provided by an aperture sealed by a chemical composition container lid 912. Dispensing of the flush assisting chemical composition 950 into the flush fluid delivery system would be controlled by a chemical composition injection flow control valve 960. A chemical composition injection flow control valve operating element 962 within the chemical composition injection flow control valve 960 would be operated by a chemical composition injection flow control valve controller 964. A monitor (not shown) can be included to monitor the currently stored volume of flush fluid supply line source 850 within the air handler condensation drain discharge flow stoppage 810 to inform a user when the volume of flush fluid supply line source 850 needs to be replenished.

Figure 15:
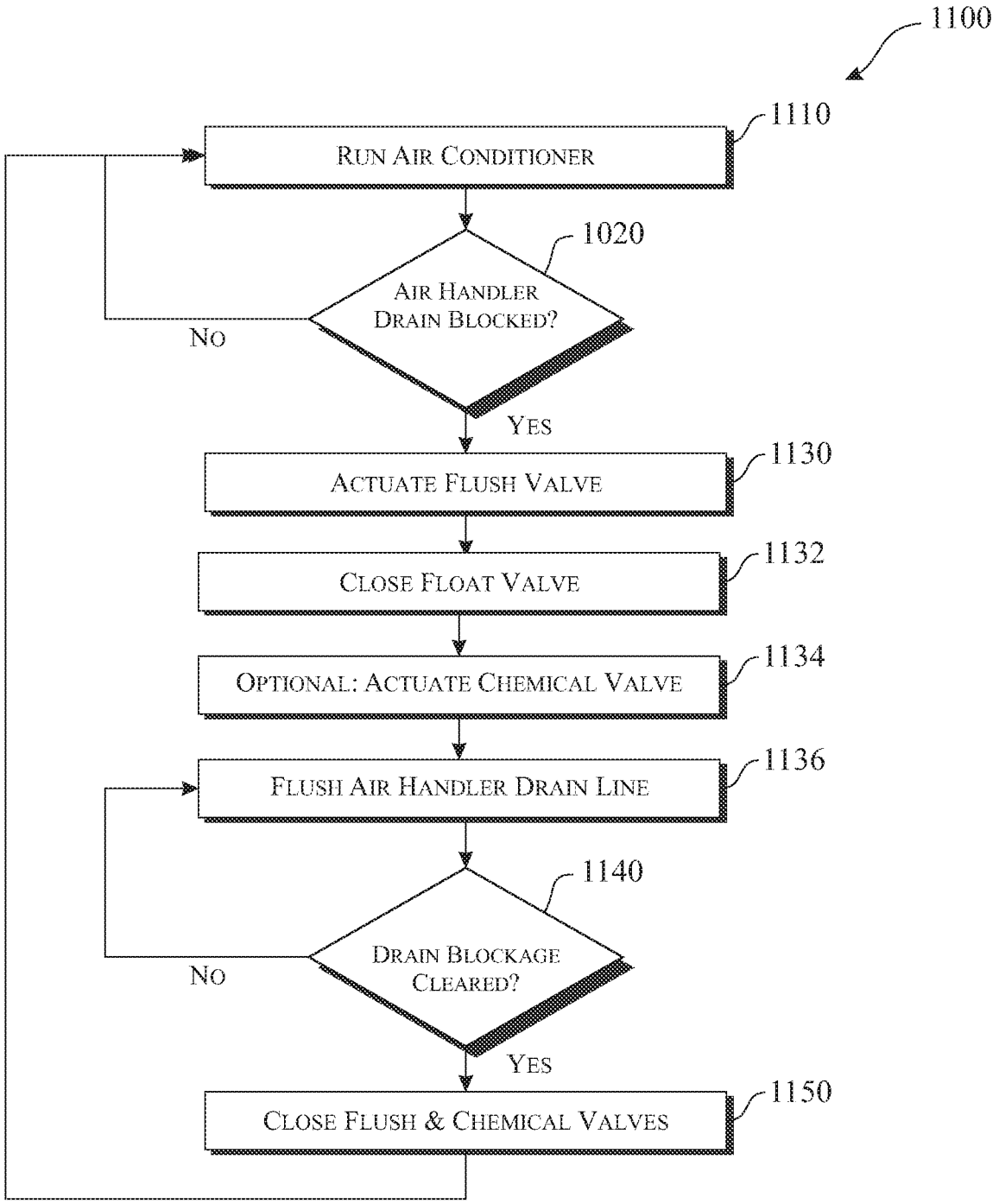
FIG. 15 presents a flow diagram describing an exemplary method of using the automated air handler drain pipe flush system.

An exemplary operation of the automated air handler drain pipe flush system 600 is outlined in a lair conditioning system 100 presented in FIG. 15. Operation of the automated air handler drain pipe flush system 600 is based upon use of the air conditioning system 100 (step 1110). During operation of the air conditioning system 100 (step 1110), condensation 801 collects in a condensation collection element 168 (illustrated as a condensation collection tray 168) located at a bottom of the air conditioning air handler 110. The collected condensation 801 drains through the air handler drain pipe connector 160 and the air handler or condensation collection drain pipe 162. The air handler drain pipe flush supply flow controller circuit 750 monitors the system to determine when an air handler condensation drain pipe blockage 899 forms within the air handler drain pipe 610, 612, 614, 616, blocking flow of the draining collected condensation 801 (decision step 1020).

Upon an indication of an air handler condensation drain pipe blockage 899, the air handler drain pipe flush supply flow controller circuit 750 would send a signal to the air handler drain pipe flush supply flow control valve controller 764 to actuate the air handler drain pipe flush supply flow control valve 760, causing the air handler drain pipe flush supply flow control valve operating element 762 to toggle from a closed configuration (FIGS. 10 through 12) to an open configuration (FIG. 13) (step 1130). By opening the air handler drain pipe flush supply flow control valve 760, a volume of flush fluid 841 is enabled from flow the flush supply line source flow 840 to a location of the air handler condensation drain pipe blockage 899 within the air handler drain pipe 610, 612, 614, 616 to apply a pressure against the air handler condensation drain pipe blockage 899. As the flush fluid 841 enters the piping, a portion of the flush fluid 841 can flow upstream (identified as flush valve actuating flow 845), ensuring the float valve actuator assembly 700 is closed (step 1132). The flush fluid 841 would raise the float element 730 against the float valve ring seal 715, creating a fluid impervious seal. The float element 730 might seal against the float valve ring seal 715 simply from backflow of the flowing collected condensation 801. The combination of the float element 730 and the float valve ring seal 715 assembled within the float valve actuator enclosure 710 provides a function of a condensation backflow check valve (710, 715, 730) and can be referred to as such.

When available, the air handler drain pipe flush supply flow controller circuit 750 would actuate the chemical composition injection flow control valve 960 (step 1134), dispensing a volume of flush assisting chemical composition 950 to combine with the flush fluid 841 to aid in dislodging and clearing the air handler condensation drain pipe blockage 899. The air handler drain pipe flush supply flow controller circuit 750 can control the dispensing of the flush assisting chemical composition 950 over the entire flush cycle (step 1136), a portion of the flush cycle, over a predetermined time, to dispense a predetermined volume of flush assisting chemical composition 950, and the like. In a preferred operation, the chemical composition injection flow control valve 960 would dispense the flush assisting chemical composition 950 during an initial portion of a flush cycle and cease dispensing during a latter portion of the flush cycle, enabling the flush fluid 841 to rinse any residual flush aiding chemical composition from the air handler drain pipe 610, 612, 614, 616.

Figure 13:
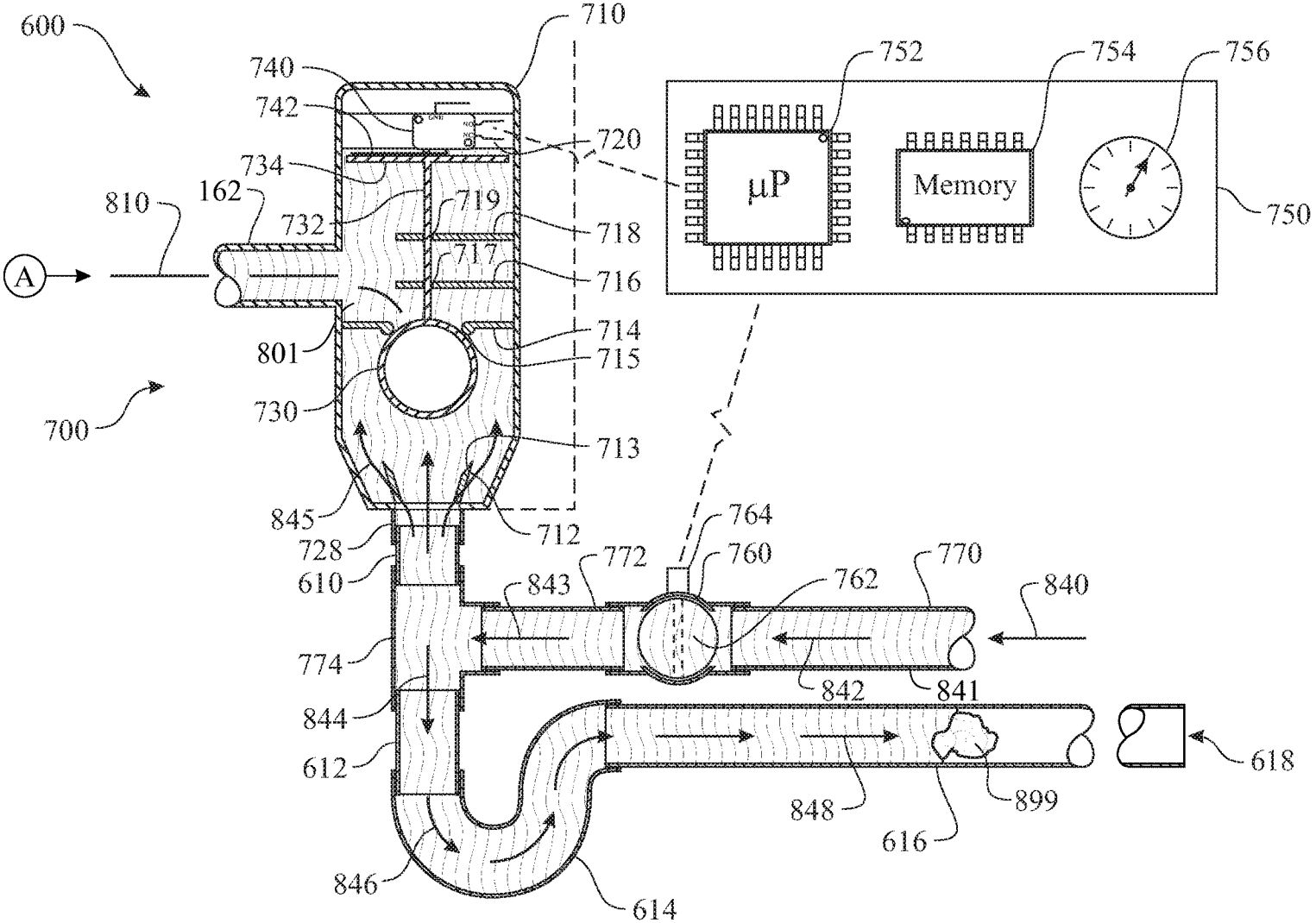
FIG. 13 presents a sectioned elevation view of the exemplary automated air handler drain pipe flush system, the illustration presenting a configuration having the float valve in the closed condition and the drain pipe flush system in a flush mode enabling flush fluid to flow towards the blockage in the air handler drain pipe to remove the blockage from within the air handler drain pipe.

The flow of the flush fluid 841 would apply a pressure against the air handler condensation drain pipe blockage 899 to clear the air handler condensation drain pipe blockage 899 from the air handler drain pipe 610, 612, 614, 616 (step 1136), as shown in FIG. 13. The flush process can be applied based upon a period of time, based upon a volume of flush fluid 841, based upon a change in pressure, and the like. Once the flush process reaches a predetermined termination point, the air handler drain pipe flush supply flow controller circuit 750 closes the air handler drain pipe flush supply flow control valve 760. The air handler drain pipe flush supply flow controller circuit 750 would monitor the status of the air handler condensation drain pipe blockage 899 by obtaining signals from the float operated switch 740, the air handler float switch assembly 170, any pressure within the air handler drain pipe 610, 612, 614, 616, or any other method to determine the status of the air handler condensation drain pipe blockage 899 therein (decision step 1140). In one example, when the air handler condensation drain pipe blockage 899 is cleared, the flush fluid 841 would flow through the discharge orifice located at the drain pipe distal end 618 of the downstream drain pipe section 616. This would relieve pressure or remove the flush fluid 841 from within the float valve actuator enclosure 710, this separating the float actuator plate 734 from the float switch actuator arm 742. This toggles the status of the float operated switch 740, indicating that the air handler condensation drain pipe blockage 899 is cleared. The air handler drain pipe flush supply flow controller circuit 750 would use the acquired signal information to determine if the air handler condensation drain pipe blockage 899 is cleared. In a condition where the air handler drain pipe flush supply flow controller circuit 750 determines that the air handler condensation drain pipe blockage 899 is cleared, the air handler drain pipe flush supply flow controller circuit 750 would proceed in closing the air handler drain pipe flush supply flow control valve operating element 762 of the air handler drain pipe flush supply flow control valve 760 and, when applicable, closing the chemical composition injection flow control valve operating element 962 of the chemical composition injection flow control valve 960 (step 1150).

Figure 16:
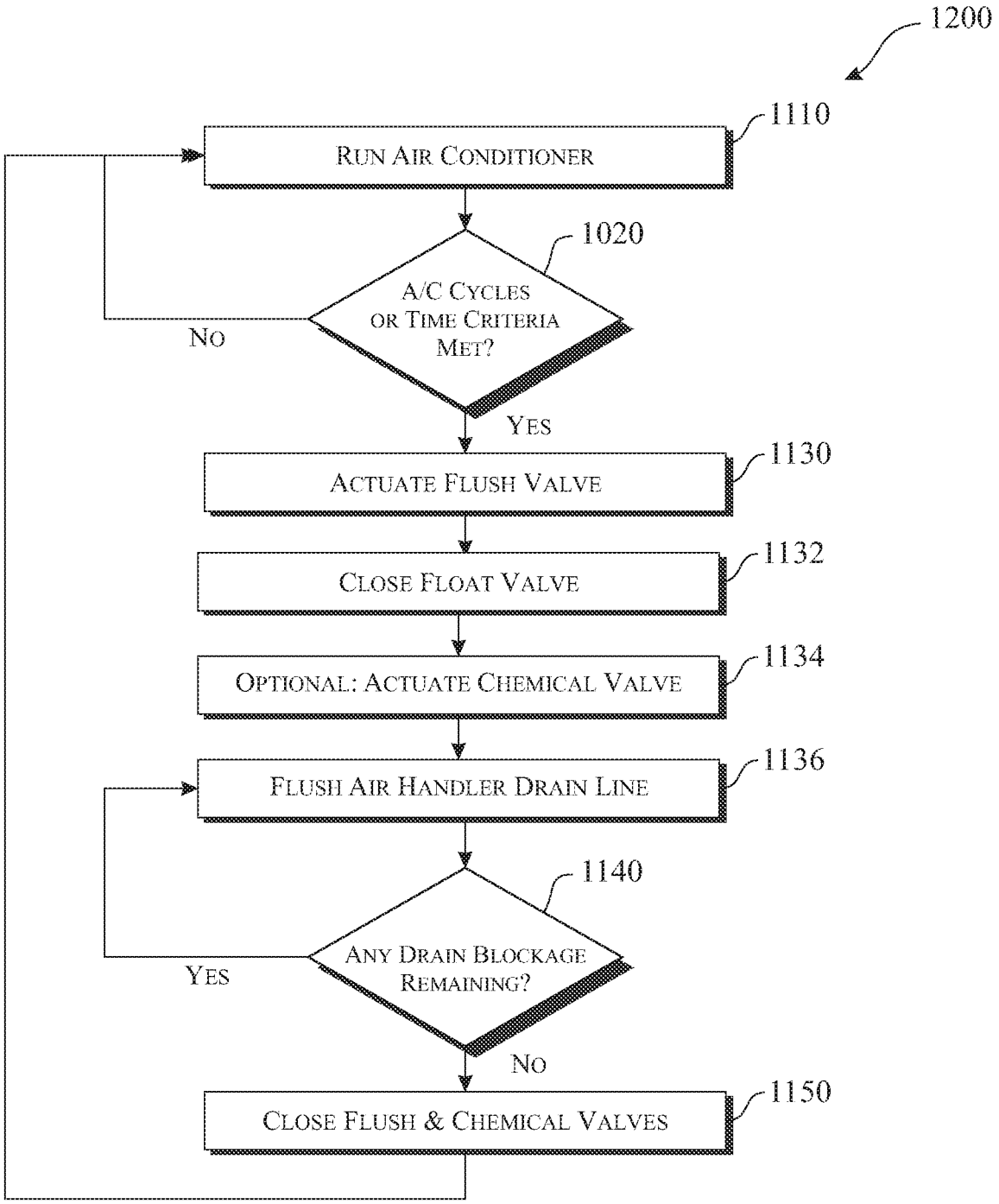
FIG. 16 presents a flow diagram describing an exemplary alternative method of using the automated air handler drain pipe flush system.

An alternative operation of the automated air handler drain pipe flush system 600, referenced as an air handler drain clog flush process 1200, is presented in FIG. 16. The distinguishing operation between the air handler drain clog flush process 1200 and the lair conditioning system 100 is that the air handler drain clog flush process 1200 employs a proactive decision step (decision step 1020) to initiate an operation of the automated air handler drain pipe flush system 600. In accordance with the air handler drain clog flush process 1200, operation of the automated air handler drain pipe flush system 600 is based upon a number of cycles of the air conditioning system 100 (decision step 1020).

In one exemplary condition, the air handler drain pipe flush supply flow controller circuit 750 would activate the system based upon a predetermined number of operating cycles of the air conditioning system 100. The cycles would be identified by a communication link between the air handler drain pipe flush supply flow controller circuit 750 and the air conditioning thermostat 180. The air handler drain pipe flush supply flow controller circuit 750 can be programmed to activate the system 600 after each cycle, after every other cycle, after any predetermined quantity of cycles, or randomly. In a second exemplary condition, the air handler drain pipe flush supply flow controller circuit 750 would activate the system 600 based upon a predetermined time span, such as once a day, once every other day, once every predetermined number of days, once a week, once every two weeks, once a month, once every other month, randomly, or any other suitable setting. In a third exemplary condition, the air handler drain pipe flush supply flow controller circuit 750 would activate the system 600 based upon a predetermined number of operating cycles of the air conditioning system 100 and based upon a predetermined time span, whichever is shorter or whichever is longer, all dependent upon the user's desired settings.

Although the disclosure defines several optional methods of operation, it is understood that any suitable method known by those skilled in the art can be employed to contribute to the heat exchanger rinse system 500 and/or automated air handler drain pipe flush system 600. For example, a flow meter can be placed at a drain pipe distal end 618 of the downstream drain pipe section 616 to determine if an air handler condensation drain pipe blockage 899 is present within the air handler drain pipe 610, 612, 614, 616. The float valve actuator assembly 700 can be replaced by a float switch activating an electrically operated valve or a check valve.

In one exemplary enhancement, the rinse additive provided by the rinse cleaning composition delivery system 530 can be scented, where the scent would then be disseminated through the air conditioning ducting 150.

In another exemplary configuration, the heat exchanger rinse system 500, the automated air handler drain pipe flush system 600, and/or the scent dispersion system 200 can be integrated into the same air conditioning air handler 110. The rinse fluid and the flush fluid 841 can be supplied from the same source or different sources. The heat exchanger rinse system 500 and the automated air handler drain pipe flush system 600 can be programmed to operate in conjunction with one another or independent of one another.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTIONS

Ref. No. Description

100 scenting central air conditioning system
110 air conditioning air handler
112 air handler housing
114 pressure divider wall
116 low pressure section
118 high pressure section
120 air handler fan
122 heat exchanger
130 compressor assembly
132 compressor housing
134 compressor
136 compressor fan
140 refrigerant supply conduit
142 refrigerant return conduit
150 air conditioning ducting
152 trunk ducting
154 branch ducting
156 ducting transition
158 vent
160 air handler drain pipe connector
162 air handler drain pipe
168 condensation collection tray
170 air handler float switch assembly
172 float element for the air handler float switch assembly
174 float operated switch for the air handler float switch assembly
180 air conditioning thermostat
182 air conditioning thermostat microprocessor
184 air conditioning thermostat thermometer
186 air conditioning thermostat system controller
200 scent dispersion system
210 scent injection assembly
212 scent reservoir
214 releasable reservoir coupling
216 integrated scent injection body
220 inlet coupler
222 inlet orifice
224 discharge coupler
226 discharge orifice
228 scent dispersion flow valve control
230 pressure application conduit
232 pressure application orifice
234 post valve pressure application conduit
236 scent injection conduit
238 scent injection orifice
240 scent operation control valve
250 pressure airflow
252 scent injection airflow
254 scented and conditioned air mixture
260 scent generating liquid
262 scent generating vapor
264 generated scented air bubbles
270 scent dispersing reed
272 reed seating recession
280 ultrasonic system controller
282 ultrasonic scent disbursement head
284 electrical interface
286 fluid conduit
288 vaporized scent
300 aerator
310 aerating conduit
312 aerating conduit lower apex
320 backflow prevention device
322 aerator discharge port
340 scent injection assembly upper check valve
342 scent injection assembly lower check valve
400 aerator
410 aerating conduit
440 scent injection assembly upper check valve
450 aerator shaft
452 lower shaft bearing
454 upper shaft bearing
460 aerating blade assembly
462 drive blade assembly
500 heat exchanger rinse system
510 heat exchanger rinse fluid delivery conduit
512 heat exchanger rinse fluid delivery component
520 heat exchanger rinse supply flow control valve
522 heat exchanger rinse supply flow control valve actuator
530 rinse cleaning composition delivery system
532 rinse cleaning composition reservoir
534 rinse cleaning composition reservoir fill cap
536 chemical cleaning composition
540 rinse cleaning composition supply valve
542 rinse cleaning composition supply valve actuator
544 rinse cleaning composition supply valve coupling element
550 air handler heat exchanger rinse system controller circuit
552 microprocessor
554 non-volatile digital memory
556 clocking circuit
560 heat exchanger rinse fluid source
562 heat exchanger rinse application
600 automated air handler drain pipe flush system
610 upstream drain connection pipe section
612 downstream drain connection pipe section
614 J trap drain pipe section"
616 downstream drain pipe section
618 drain pipe distal end
700 float valve actuator assembly
710 float valve actuator enclosure
712 float body support member
713 float body support member contact surface
714 float valve ring
715 float valve ring seal
716 float valve lower control arm
717 float valve lower control arm guide aperture
718 float valve upper control arm
719 float valve upper control arm guide aperture

720 float switch mount
728 float switch discharge coupler
730 float element
732 float actuator column
734 float actuator plate
740 float operated switch
742 float switch actuator arm
750 air handler drain pipe flush supply flow controller circuit
752 microprocessor
754 non-volatile digital memory device
756 clocking circuit
760 air handler drain pipe flush supply flow control valve
762 air handler drain pipe flush supply flow control valve operating element
764 air handler drain pipe flush supply flow control valve controller
770 upstream flush fluid supply pipe
772 downstream flush fluid supply pipe
774 flush fluid supply system connecting adapter
800 air handler condensation source flow
801 collected condensation from air handler
802 air handler condensation float valve bypass flow
804 air handler condensation pre-J trap drain flow
806 air handler condensation J trap drain flow
808 air handler condensation post J trap drain flow
809 air handler condensation drain discharge flow
810 air handler condensation drain discharge flow stoppage
812 air handler condensation float valve bypass flow stoppage
814 air handler condensation pre-J trap drain flow stoppage
816 air handler condensation J trap drain flow stoppage
820 air handler flush valve drain flow return
830 air handler flush valve drain flow return stoppage
840 flush supply line source flow
841 flush fluid
842 flush supply line upstream flow
843 flush supply line downstream flow
844 flush pre-J trap drain flow
845 flush valve actuating flow
846 flush J trap drain flow
848 flush post J trap drain flow
850 flush fluid supply line source
852 blocked flush fluid supply line source
899 air handler condensation drain pipe blockage
900 chemical composition injection system
910 chemical composition container
912 chemical composition container lid
950 flush assisting chemical composition
960 chemical composition injection flow control valve
962 chemical composition injection flow control valve operating element
964 chemical composition injection flow control valve controller
974 chemical composition injection system coupling T
1000 air handler heat exchanger rinse process
1010 cycle air conditioner step
1020 air conditioning cycle count or time criteria decision step
1030 actuate rinse valve step
1034 optional actuate chemical injection valve step
1036 rinse heat exchanger step
1040 rinse cycle complete decision step
1050 close rinse and optional chemical valve step
1100 air handler drain clog flush process
1110 run air conditioner step
1120 air handler drain line blocked decision step
1130 actuate flush valve step
1132 close float valve step
1134 optional actuate chemical injection valve step
1136 flush air handler drain line step
1140 drain blockage cleared decision step
1150 close flush and optional chemical valve step
1200 air handler drain clog flush process

What is claimed is:

1. An air handler of an air conditioning system comprising: an air handler drain pipe providing fluid communication between a condensation collection tray of the air handler and a discharge end of the air handler drain pipe; an automated air conditioning air handler condensation drain pipe flush system adapted to inject flush fluid into a downstream portion of the air handler drain pipe, the automated air conditioning air handler condensation drain pipe flush system comprising: a flush fluid supply pipe providing fluid communication between a flush fluid supply source and the downstream portion of the air handler drain pipe, an air handler drain pipe flush supply flow control valve adapted to control a flow of flush fluid between the flush fluid supply source and the downstream portion of the air handler drain pipe, an air handler drain pipe flush supply flow controller circuit adapted to control operation of the air handler drain pipe flush supply flow control valve; a float element; a float operated switch installed at a location and configured to engage with the float element, wherein when the float element rises to a predetermined position resulting from a drain pipe blockage blocking the air handler condensation drain flow through the air handler drain pipe, the motion of the float element directly causes the float operated switch to toggle between a flush system deactivated state and a flush system activation state; and a condensation backflow check valve, provided between the condensation collection tray of the air handler and the air handler drain pipe flush supply flow control valve, wherein the condensation backflow check valve is adapted to close when flow stops resulting from the drain pipe blockage, wherein the float element is located in at least one of: (a) at a location directly above the condensation collection tray of the air handler where the float element contacts condensation collected and contained within the condensation collection trays wherein the float element is arranged to raise when the drain pipe blockage blocks air handler condensation drain flow through the downstream portion of the air handler drain pipe and the float element actuate the float operated switch when the float element reaches a predetermined position, and (b) integrated into the condensation backflow check valve, wherein the float element is arranged to create a seal restricting any flow through the condensation backflow check valve in a direction towards the air handler condensation tray when the drain pipe blockage is present, wherein the condensation backflow check valve comprises of a float valve upper control arm; the float valve upper control arm comprises of a float valve upper control arm aperture to provide for a float actuator column to assist with the stabilization of the float element; wherein the float element is arranged to raise when the drain pipe blockage blocks air handler condensation drain flow through the downstream portion of the air handler drain pipe, and the float element is arranged to actuate the float operated switch as the float element reaches a sealed position.

2. An air handler of the air conditioning system as recited in claim 1, the check valve further comprising a float valve ring seal, wherein the float element is integrated into the check valve, wherein, in operation, at least one of: (a) stoppage of the handler condensation drain flow and (b) the flush fluid rises the float element against the float valve ring seal creating the fluid impervious seal between a portion of the air handler drain pipe upstream of the air handler drain pipe flush supply flow control valve and a portion of the air handler drain pipe downstream of the air handler drain pipe flush supply flow control valve.

3. An air handler of the air conditioning system as recited in claim 1, wherein the float element is integrated into the check valve, wherein the float operated switch is assembled to the check valve in a configuration where the float operated switch is operated by the rising of the float element, wherein the float operated switch provides a signal indication of a status of the check valve to the air handler drain pipe flush supply flow controller circuit.

4. An air handler of the air conditioning system as recited in claim 1, the air handler drain pipe flush supply flow controller circuit further comprising a microprocessor, a non-volatile digital memory in signal communication with the microprocessor, and a clocking circuit in signal communication with the microprocessor.

5. An air handler of the air conditioning system as recited in claim 1, the air conditioning system further comprising a thermostat, the thermostat being adapted to control operation of the air conditioning system, wherein the air handler drain pipe flush supply flow controller circuit is provided in signal communications with the thermostat.

6. An air handler of the air conditioning system as recited in claim 1, the air handler drain pipe further comprising a section shaped and functioning as a J trap, the J trap being located in a portion of the air handler drain pipe downstream of the air handler drain pipe flush supply flow control valve.

7. An air handler of the air conditioning system as recited in claim 1, the air handler drain pipe flush system further comprising a chemical composition injection system, the chemical composition injection system adapted to dispense a flush assisting chemical composition into the downstream portion of the air handler drain pipe to aid the flush fluid in clearing the drain pipe blockage within the downstream portion of the air handler drain pipe.

8. An air handler of the air conditioning system as recited in claim 1, further comprising an air handler heat exchanger rinse system, the air handler heat exchanger rinse system comprising:

a heat exchanger rinse fluid delivery conduit providing fluid communication between a rinse fluid source and at least one rinse fluid delivery component positioned to dispense rinse fluid onto an air handler heat exchanger of the air handler of the air conditioning system;

a rinse supply flow control valve adapted to control a flow of rinse fluid between the rinse fluid source and the at least one rinse fluid delivery component; and an air handler heat exchanger rinse system controller circuit adapted to control operation of the rinse supply flow control valve.

9. An air handler of the air conditioning system as recited in claim 8, the air handler heat exchanger rinse system further comprising a rinse cleaning composition delivery system, the rinse cleaning composition delivery system adapted to introduce a volume of a chemical cleaning composition into the rinse fluid.

10. An air handler of the air conditioning system as recited in claim 9, the chemical cleaning composition being at least one of:

a disinfectant composition, an antibacterial composition, an antimicrobial composition, an antifungal composition, and a scented composition.

11. An air handler of an air conditioning system comprising: an air handler drain pipe providing fluid communication between a condensation collection tray of the air handler and a discharge end of the air handler drain pipe; an automated air conditioning air handler condensation drain pipe flush system adapted to inject flush fluid into a downstream portion of the air handler drain pipe, the automated air conditioning air handler condensation drain pipe flush system comprising: a flush fluid supply pipe providing fluid communication between a flush fluid supply source and a downstream portion of the air handler drain pipe, an air handler drain pipe flush supply flow control valve adapted to control a flow of flush fluid between the flush fluid supply source and the downstream portion of the air handler drain pipe, an air handler drain pipe flush supply flow controller circuit adapted to control operation of the air handler drain pipe flush supply flow control valve; and a condensation backflow check valve provided between the condensation collection tray of the air handler and the air handler drain pipe flush supply flow control valve, the condensation backflow check valve comprising a float element, a float valve ring seal, and a float operated switch, the float element arranged to engage and disengage with the float valve ring seal and to actuate the float operated switch as the float element reaches a sealed position, wherein the condensation backflow check valve comprises of a float valve upper control arm; the float valve upper control arm comprises of a float valve upper control arm aperture to provide for a float actuator column to assist with the stabilization of the float element; the float element movement is based upon a fluid level on a downstream side of the float element, wherein the condensation backflow check valve is adapted to operate in accordance with at least one of: based upon a buildup of collected condensation within the downstream portion of the air handler drain pipe, the buildup of collected condensation resulting from an air handler condensation drain pipe blockage formed within the downstream portion of the air handler condensation drain pipe, and based upon a backflow of flush fluid from the flush supply line source flow, wherein when the float element rises to a predetermined location resulting from the air handler condensation drain pipe blockage blocking the air handler condensation drain flow through the air handler drain pipe, the motion of the float element directly causes the float operated switch to change to a rinse activation state.

12. An air handler of the air conditioning system as recited in claim 11, the condensation backflow check valve further comprising a float valve ring seal, wherein, in operation, when the float element is positioned against the float valve ring seal, the float element creates a fluid impervious seal between a portion of the air handler drain pipe upstream of the air handler drain pipe flush supply flow control valve and a portion of the air handler drain pipe downstream of the air handler drain pipe flush supply flow control valve.

13. An air handler of the air conditioning system as recited in claim 11, wherein the float operated switch is assembled to the condensation backflow check valve in a configuration where the float operated switch is operated by the rising of the float element, wherein the float operated switch provides a signal indication of a status of the check valve to the air handler drain pipe flush supply flow controller circuit.

14. An air handler of the air conditioning system as recited in claim 11, the air handler drain pipe flush supply flow controller circuit further comprising a microprocessor, a non-volatile digital memory in signal communication with the microprocessor, and a clocking circuit in signal communication with the microprocessor.

15. An air handler of the air conditioning system as recited in claim 11, the air conditioning system further comprising a thermostat, the thermostat being adapted to control operation of the air conditioning system, wherein the air handler drain pipe flush supply flow controller circuit is provided in signal communications with the thermostat.

16. An air handler of the air conditioning system as recited in claim 11, the air handler drain pipe further comprising a section shaped and functioning as a J trap, the J trap being located in a portion of the air handler drain pipe downstream of the air handler drain pipe flush supply flow control valve.

17. An air handler of the air conditioning system as recited in claim 11, the air handler drain pipe flush system further comprising a chemical composition injection system, the chemical composition injection system adapted to dispense a flush assisting chemical composition into the downstream portion of the air handler drain pipe to aid the flush fluid in clearing the air handler condensation drain pipe blockage within the downstream portion of the air handler drain pipe.

18. An air handler of the air conditioning system as recited in claim 11, the air handler further comprising an air handler heat exchanger rinse system, the air handler heat exchanger rinse system comprising:

a heat exchanger rinse fluid delivery conduit providing fluid communication between a rinse fluid source and at least one rinse fluid delivery component positioned to dispense rinse fluid onto an air handler heat exchanger of the air handler of the air conditioning system;

a rinse supply flow control valve adapted to control a flow of rinse fluid between the rinse fluid source and the at least one rinse fluid delivery component; and an air handler heat exchanger rinse system controller circuit adapted to control operation of the rinse supply flow control valve.

19. An air handler of the air conditioning system as recited in claim 18, the air handler heat exchanger rinse system further comprising a rinse cleaning composition delivery system, the rinse cleaning composition delivery system adapted to introduce a volume of a chemical cleaning composition into the rinse fluid.

20. An air handler of the air conditioning system as recited in claim 19, the chemical cleaning composition being at least one of:

a disinfectant composition,
an antibacterial composition,
an antimicrobial composition,
an antifungal composition, and
a scented composition.

* * * * *